US009816323B2

(12) United States Patent
Fossli

(10) Patent No.: US 9,816,323 B2
(45) **Date of Patent: *Nov. 14, 2017**

(54) SYSTEMS AND METHODS FOR SUBSEA DRILLING

(71) Applicant: Enhanced Drilling AS, Straume (NO)

(72) Inventor: Borre Fossli, Oslo (NO)

(73) Assignee: ENHANCED DRILLING AS, Straume (NO)

( * ) Notice: Subject to any disclaimer, the term of this patent is extended or adjusted under 35 U.S.C. 154(b) by 1 day.

This patent is subject to a terminal disclaimer.

(21) Appl. No.: 14/950,122

(22) Filed: Nov. 24, 2015

(65) Prior Publication Data

US 2016/0076306 A1 Mar. 17, 2016

Related U.S. Application Data

(63) Continuation of application No. 14/170,666, filed on Feb. 3, 2014, now Pat. No. 9,222,311, which is a continuation of application No. 12/936,254, and a continuation-in-part of application No.
(Continued)

(30) Foreign Application Priority Data

Apr. 4, 2008 (NO) ..... 20081668
Aug. 8, 2008 (NO) ..... 20083453

(51) Int. Cl.

| | |
|---|---|
| ***E21B 7/12*** | (2006.01) |
| ***E21B 21/00*** | (2006.01) |
| ***E21B 21/08*** | (2006.01) |
| ***E21B 21/06*** | (2006.01) |
| ***E21B 33/06*** | (2006.01) |

(Continued)

(52) U.S. Cl.
CPC ..... *E21B 7/12* (2013.01); *E21B 21/001* (2013.01); *E21B 21/067* (2013.01); *E21B 21/08* (2013.01); *E21B 33/06* (2013.01); *E21B 41/0007* (2013.01); *E21B 43/36* (2013.01)

(58) Field of Classification Search
CPC ..... E21B 43/121
USPC ..... 166/369, 372, 105.5; 175/5–10
See application file for complete search history.

(56) References Cited

U.S. PATENT DOCUMENTS 3,554,277 A * 1/1971 Bauer ..... E21B 7/128 166/338
3,603,409 A * 9/1971 Watkins ..... E21B 7/128 166/352

(Continued)

*Primary Examiner* — Matthew R Buck
*Assistant Examiner* — Aaron L Lembo
(74) *Attorney, Agent, or Firm* — Maine Cernota & Rardin

(57) ABSTRACT

A subsea drilling method and system controls drilling fluid pressure in the borehole of a subsea well, and separates gas from the drilling fluid. Drilling fluid is pumped into the borehole through a drill string and returned through an annulus between the drill string and the well bore and between the drill string and a riser. Drilling fluid pressure is controlled by draining fluid out of the riser or a BOP at a level between the seabed and the surface in order to adjust the hydrostatic head of drilling fluid in the riser. The drained drilling fluid and gas is separated in a subsea separator, where the gas is vented to the surface through a vent line, and the fluid is pumped to the surface via a subsea pump. A closing device and a choke line and valve can release pressure after a gas kick in the well.

10 Claims, 20 Drawing Sheets

Related U.S. Application Data

PCT/NO2009/000136, filed on Apr. 6, 2009, now Pat. No. 8,640,778.

(51) Int. Cl.
*E21B 43/36* (2006.01)
*E21B 41/00* (2006.01)

(56) References Cited

U.S. PATENT DOCUMENTS 3,630,002 A * 12/1971 Burrus ..... B01D 19/0063 96/164
3,785,445 A * 1/1974 Scozzafava ..... E21B 7/128 175/27
3,794,125 A * 2/1974 Nelson ..... E21B 7/124 166/350
3,815,673 A * 6/1974 Bruce ..... E21B 7/128 166/359
3,825,065 A * 7/1974 Lloyd ..... E21B 7/128 166/351
3,833,060 A * 9/1974 Craggs ..... E21B 43/129 166/106
3,969,937 A * 7/1976 Barrington ..... E21B 23/006 166/264
4,046,191 A * 9/1977 Neath ..... E21B 21/001 166/352
4,060,140 A * 11/1977 Barrington ..... E21B 27/005 166/358
4,063,602 A * 12/1977 Howell ..... E21B 7/128 175/48
4,091,881 A * 5/1978 Maus ..... E21B 21/001 175/25
4,099,583 A * 7/1978 Maus ..... E21B 7/128 175/25
4,291,772 A * 9/1981 Beynet ..... E21B 21/001 175/25
4,310,050 A * 1/1982 Bourgoyne, Jr. ..... E21B 21/00 137/501
4,310,058 A * 1/1982 Bourgoyne, Jr. ..... E21B 21/00 175/207
4,325,409 A * 4/1982 Roberts ..... E21B 33/0355 137/596.14
4,430,892 A * 2/1984 Owings ..... E21B 21/08 175/48
4,456,071 A * 6/1984 Milgram ..... E21B 43/0122 166/356
4,478,287 A * 10/1984 Hynes ..... E21B 7/128 166/341
4,709,900 A * 12/1987 Dyhr ..... E21B 21/001 251/4
4,813,495 A * 3/1989 Leach ..... E21B 7/12 166/358
6,004,385 A * 12/1999 Birmingham ..... B01D 19/0057 96/174
6,012,530 A * 1/2000 Korsgaard ..... B63B 22/026 166/352
6,276,455 B1 * 8/2001 Gonzalez ..... E21B 21/001 166/267
6,454,022 B1 * 9/2002 Sangesland ..... E21B 21/08 175/5
6,457,529 B2 * 10/2002 Calder ..... E21B 21/001 166/368
6,499,540 B2 * 12/2002 Schubert ..... E21B 21/08 166/250.08
6,651,745 B1 * 11/2003 Lush ..... E21B 43/01 166/267
6,659,181 B2 * 12/2003 Hartmann ..... E21B 33/035 166/344
6,668,943 B1 * 12/2003 Maus ..... E21B 21/001 175/212
6,725,936 B2 * 4/2004 Hopper ..... E21B 7/043 166/351
6,926,101 B2 * 8/2005 deBoer ..... E21B 21/001 175/209
6,966,392 B2 * 11/2005 deBoer ..... E21B 21/001 175/207
7,090,036 B2 * 8/2006 deBoer ..... E21B 21/001 175/66
7,093,662 B2 * 8/2006 deBoer ..... E21B 21/001 166/250.07
7,134,498 B2 * 11/2006 Hopper ..... B01D 17/00 166/267
7,159,669 B2 * 1/2007 Bourgoyne ..... E21B 21/001 166/348
7,258,171 B2 * 8/2007 Bourgoyne ..... E21B 21/001 166/348
7,264,058 B2 * 9/2007 Fossli ..... E21B 21/001 166/364
7,331,396 B2 * 2/2008 Reimert ..... E21B 33/035 166/319
7,836,973 B2 * 11/2010 Belcher ..... E21B 17/042 175/25
7,926,593 B2 * 4/2011 Bailey ..... E21B 21/08 166/338
7,992,654 B2 * 8/2011 deBoer ..... E21B 21/001 175/206
7,992,655 B2 * 8/2011 deBoer ..... E21B 21/001 175/206
8,347,982 B2 * 1/2013 Hannegan ..... E21B 19/09 166/347
2008/0210471 A1 * 9/2008 Bailey ..... E21B 21/08 175/48
2009/0236144 A1 * 9/2009 Todd ..... E21B 17/01 175/5
2011/0100710 A1 * 5/2011 Fossli ..... E21B 21/001 175/7
2017/0044856 A1 * 2/2017 Leuchtenberg ..... E21B 21/001

* cited by examiner

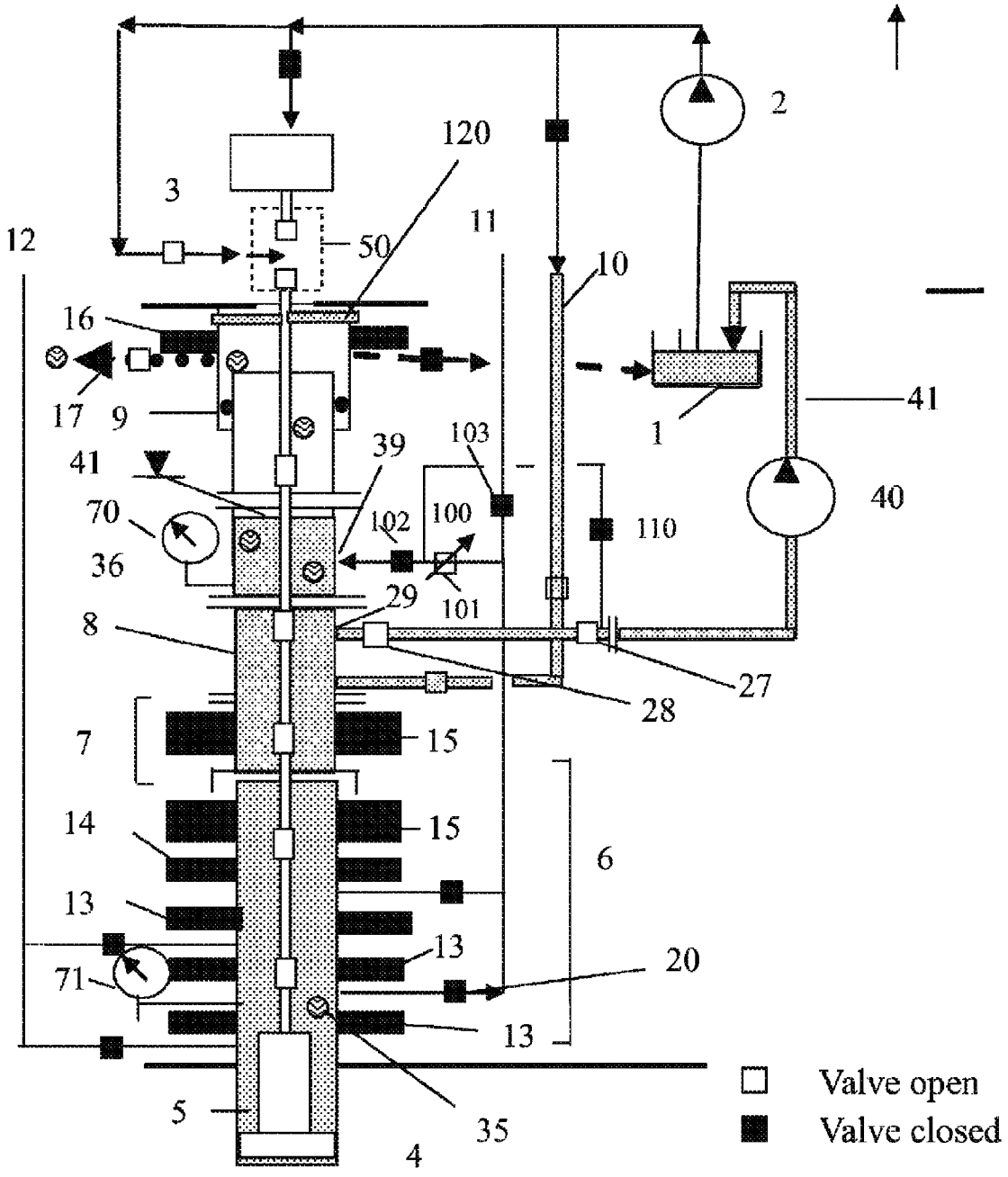
Fig. 3.1

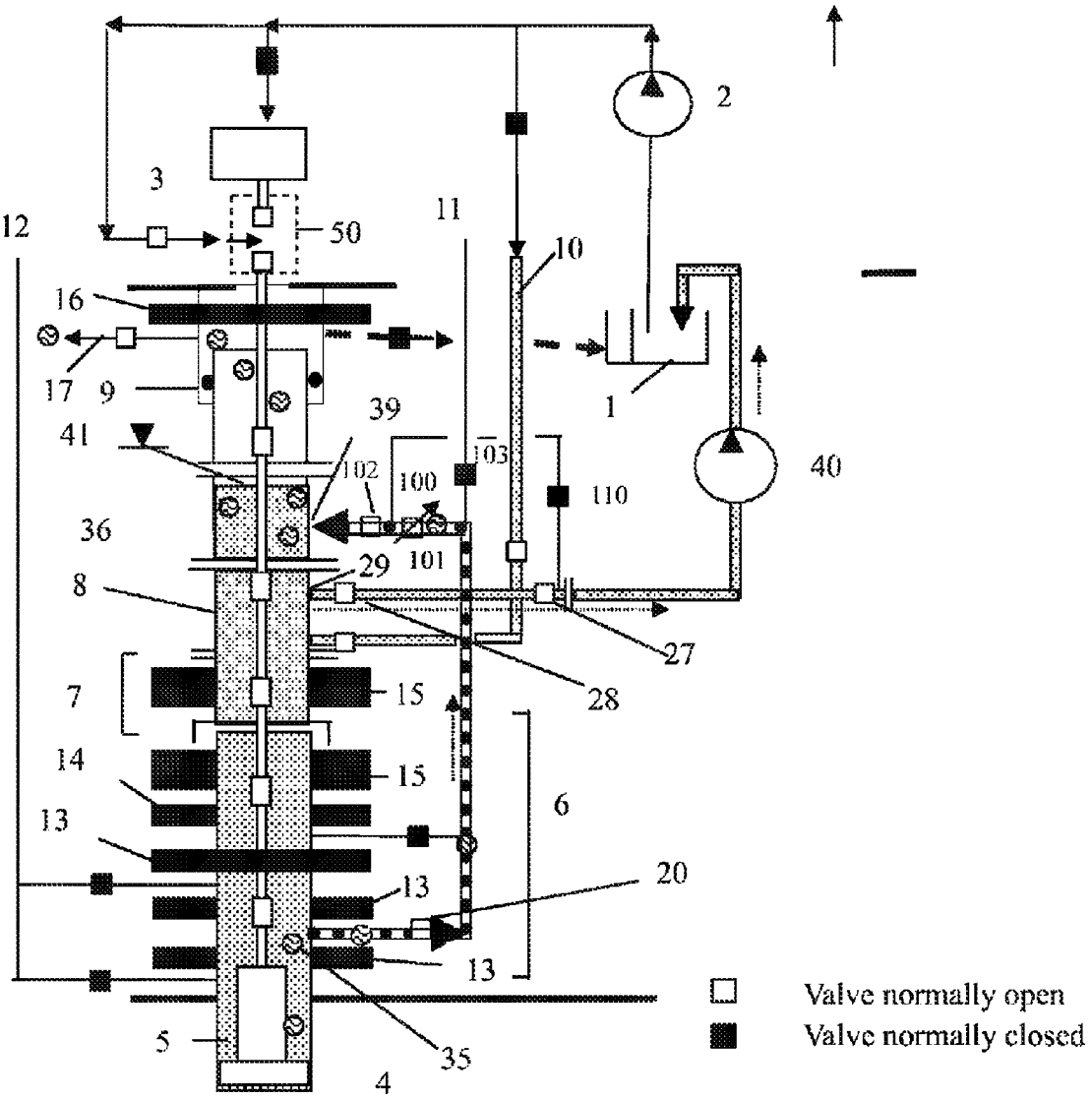
Fig. 3.2

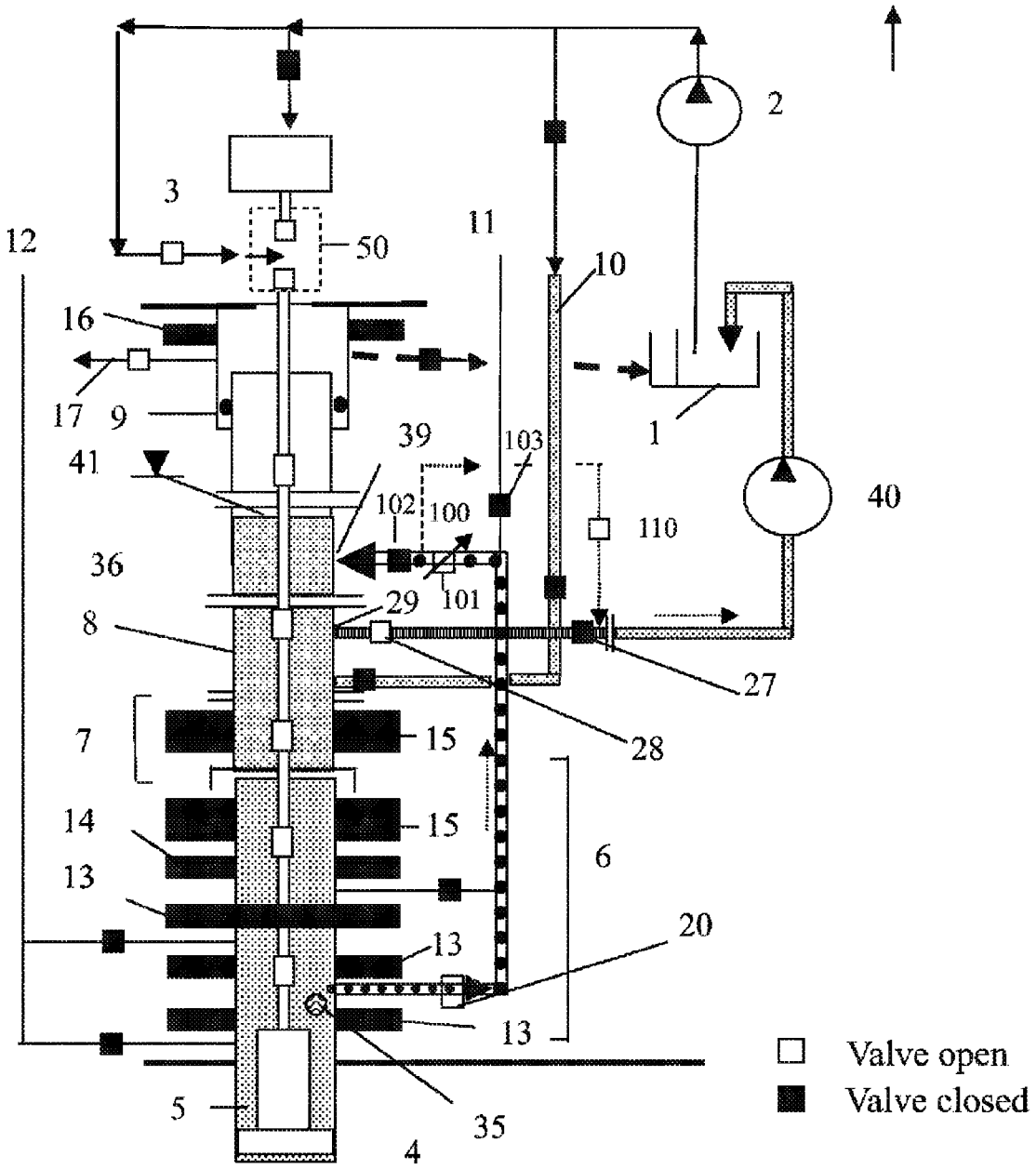
Fig. 3.3

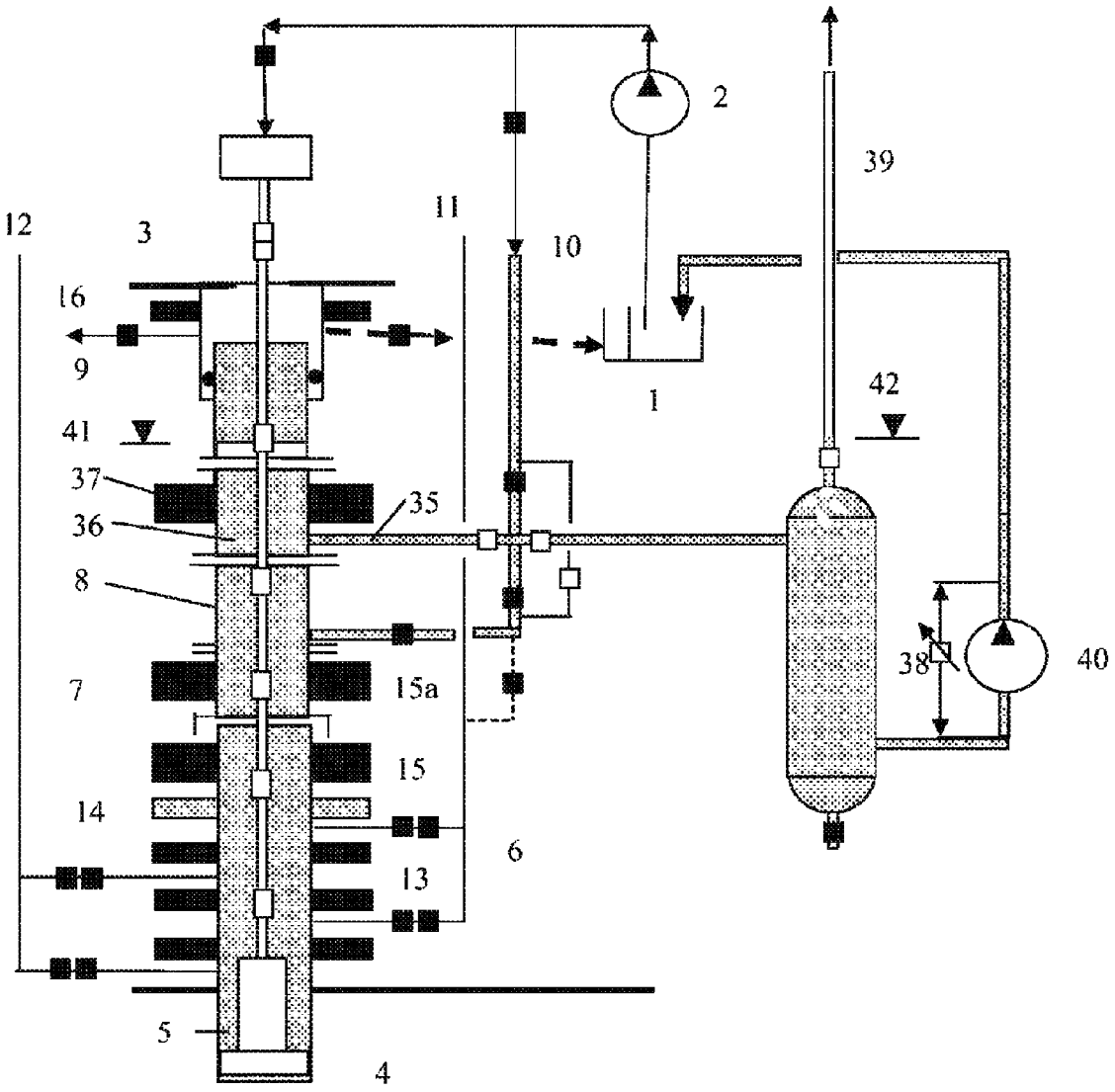
Fig. 3.4

SYSTEMS AND METHODS FOR SUBSEA DRILLING

RELATED APPLICATIONS

This application is a continuation of U.S. application Ser. No. 14/170,666. U.S. application Ser. No. 14/170,666 is a continuation of U.S. application Ser. No. 12/936,254, filed Oct. 4, 2010, which is a national phase application filed under 35 USC §371 of PCT Application No. PCT/NO2009/000136, international filing date Apr. 6, 2009, which claims priority to Norwegian Patent Application Nos. NO 2008 1668, filed Apr. 4, 2008 and NO 2008 3453, filed Aug. 8, 2008. Each and all of these applications is herein incorporated by reference in its entirety for all purposes.

FIELD OF THE INVENTION

The present invention relates to systems, methods and arrangements for drilling subsea wells, and more specifically to systems and methods for managing and regulating annular well pressures in drilling operations and in well control procedures.

BACKGROUND OF THE INVENTION

Drilling in deep waters or drilling through depleted reservoirs is a challenge due to the narrow margin between the pore pressure and fracture pressure. The narrow margin implies frequent installation of casings, and restricts the mud circulation due to frictional pressure in the annulus. Low flow rate reduces drilling speed and causes problems with transport of drill cuttings in the borehole.

Normally, two independent pressure barriers between the reservoir and the surroundings are required. In a subsea drilling operation, normally, the primary pressure barrier is the drilling fluid (mud) column in the borehole and the Blow Out Preventer (BOP) connected to the wellhead as the secondary barrier.

Floating drilling operations are more critical compared to drilling from bottom supported platforms, since the vessel is moving due to wind, waves and sea current. Further, in offshore drilling the high pressure wellhead and the BOP is placed on or near the seabed. The drilling rig at surface of the water is connected to the subsea BOP and the high pressure wellhead with a marine drilling riser containing the drilling fluid that will transport the drilled out formation to the surface and provide the primary pressure barrier. This marine drilling riser is normally defined as a low pressure marine drilling riser. Due to the great size of this riser, (normally between 14 inches to 21 inches in diameter) it has a lower internal pressure rating than the internal pressure rating requirement for the BOP and high pressure (HP) wellhead.

Therefore, smaller in diameter pipes with high internal pressure ratings are running parallel to and being attached to the lower pressure marine drilling riser main bore, the auxiliary HP lines having equal internal pressure rating to the high pressure BOP and wellhead. Normally these lines or pipes are called kill and choke lines. These high pressure lines are needed because if high pressure gas in the underground will enter the wellbore, high pressures on surface will be required to be able to transport this gas out of the well in a controlled manner. The reason for the high pressure lines are the methods and procedures needed up until now on how gas are transported (circulated) out of a well under constant bottom hole pressure. Until now it has not been possible to follow these procedures utilizing and exposing the main marine drilling riser with low pressure ratings to these pressures. Formation influx circulation from bottom/open hole has to be carried out through the high pressure auxiliary lines.

In addition to these high pressure lines, there might be a third line connected to the internal of the main drilling riser in the lower end of the riser. This line is often called the riser booster line. This line is normally used to pump drilling fluid or liquids into the main bore of the riser, so as to establish a circulation loop so that the fluids can be circulated in the marine drilling riser and in addition to circulation down the drill pipe up the annulus of the wellbore and riser to surface. The drilling riser is connected to the subsea BOP with a remotely controlled riser disconnect package often defined as the riser disconnect package (RDP). This means that if the rig loses its position, or for weather reasons the riser can be disconnected from the subsea BOP so that the well can be secured and closed in by the subsea BOP and the rig being able to leave the drilling location or free to move without being subjected to equipment limitations such as positioning or limitation to the riser slip joint stroke length.

Generally, when drilling an offshore well from a floating rig or Mobile Offshore Drilling Unit (MODU), a so called "riser margin" is wanted. A riser margin means that if the riser is disconnected the hydrostatic pressure from the drilling mud in the borehole and the seawater pressure above the subsea BOP is sufficient to maintain an overbalance against the formation fluid pressure in the exposed formation underground. (When disconnecting the marine drilling riser from the subsea BOP, the hydrostatic head of drilling fluid in the bore hole and the hydrostatic head of sea water should be equal or higher than the formation pore pressure in the open hole to achieve a riser margin). Riser margin is however difficult to achieve, particular in deep waters. In most case it is not possible due to the low drilling margins (difference between the formation pore pressure and the strength of the underground formation exposed to the hydrostatic or hydrodynamic pressure caused by the drilling fluid)

Managed pressure drilling (MPD) methods have been introduced to reduce some of the above mentioned problems. One method of MPD is the Low Riser Return System (LRRS). Such systems are explained in patent PCT/NO02/00317 and NO 318220. Other earlier reference systems are U.S. Pat. No. 6,454,022, U.S. Pat. No. 4,291,772, U.S. Pat. No. 4,046,191, U.S. Pat. No. 6,454,022.

SUMMARY OF THE INVENTION

The present invention solves several basic problems encountered with conventional drilling and with other previous art when encountering higher than expected pressure in underground formations. These high pressures are typically related to pressure increases in and above the wellbore when circulating out hydrocarbon or gas influxes. The invention regulates wellbore pressures more effectively than prior art systems and methods, both while drilling and when performing drill pipe connections. Embodiments of the invention are also able to handle well control events due to so-called under balanced conditions with little or no pressure at the surface, making these operations safer and more effective than before. Some embodiments handle well kicks effectively and safely without having to close any barrier elements (BOP's) on the seabed or on surface.

This new system and method particularly improves well control and well control procedures when drilling with such systems, and allow for fast regulation of annular pressures during drill pipe connections. When a gas is entering the wellbore at some depth, normally at the bottom, the reason is that the hydrostatic or hydrodynamic pressure inside the wellbore due to the drilling mud is lower than the fluid pressure in the pore space of the formation being penetrated. If we now assume that the formation fluid entering the wellbore is lighter than the drilling fluid (mud) in the well, this will have certain implications. In most instances the hydrocarbons (oil & gas) has a lower specific gravity (density) than the drilling fluid in the wellbore. Depending on the amount of carbon molecules, pressure and temperature, the gas density at depth will be in the range of typically 0.1 to 0.25 specific gravity (sg), asccompared to the drilling fluid, which can range between 0.78 specific gravity (sg) (base oil) to 2.5 (heavy brine).

In normal, conventional drilling operations the drilling riser is filled with a drilling fluid which is spilling over the top at a fixed level (flow line), and normally gravity feeds into a mud process plant (not shown) and mud pits 1 (FIG. 1) at the drilling installation on surface. However, other previous art has suggested that the riser could be filled with a lighter liquid than the drilling mud, such as seawater. This is envisioned by Beynet, U.S. Pat. No. 4,291,772, in that the lightweight fluid in the riser is connected to a tank with a level sensor.

However Beynet is different in that he has a pump which maintains a constant interface of light weight fluid and heavy mud and use a pump to transfer the drilling fluid and formation to the vessel and the mud process plant. Hence the effect will be the same when a gas kick occurs. Light gas will occupy a certain length of the borehole between the formation and drill string/bottom hole assembly. When a certain volume of gas with light density occupy a certain length or vertical height of the wellbore, heavier fluid (mud or water) is being pushed out at the top of the riser/well, so as it can no longer exert a pressure to the bottom of the hole. As more gas is coming into the well the more fluid is being displaced out of the well on top. As the formation influx normally is lighter than the drilling fluid occupying the space before, the result will be that the bottom hole pressure will get lower and lower and thereby accelerating the imbalance between the wellbore pressure and the formation pore pressure.

This process must be contained, hence the need for a blowout preventer that can contain this imbalance and shut in/stop the flow from the underground formation. As a result of lighter fluids (hydrocarbon/gas influx) occupying a certain height in the wellbore, the well will hence be closed in with a pressure in the well below the subsea BOP (15 in FIG. 1B) and in the choke line (11 in FIG. 1B) running from the subsea BOP to surface where the pressure is contained by a closed pressure regulating valve (choke) (60 in FIG. 1B). Now, if the well is shut in with a certain amount of gas in the bottom of the well there will be pressure on the top of the well. The magnitude of this pressure will depend on several factors. These factors can be; 1) the vertical height of the gas column (2)) the difference in hydrostatic pressure from the drilling mud and the formation pore pressure before the influx of gas and 3) the vertical depth where the gas is located and several more factors.

Let's now assume that the gas occupy a certain height from the bottom of the well to a certain height up-hole (a gas bubble). The BOP has been shut in at seabed with choke line (11 in FIG. 1B) open to the choke manifold at the drilling vessel (60 in FIG. 1B). The pressure measured at surface will depend on the factors mentioned above. If this gas is left as a bubble and because gas is lighter than mud (liquid), the gas will start to migrate upwards (assuming a vertical well or moderately deviated from vertical). If this gas migration is allowed to happen without allowing the gas to expand, it could be catastrophic since the bottom hole pressure would be transferred up to surface with the gas. The combined effect would be ever increasing pressure at the bottom of the well and to the extent that it would fracture the formation and possibly cause an underground blow-out. This cannot be allowed to happen.

Now, if the gas moves up the hole either by gravity separation or being pumped out of the hole in a conventional well control procedure, it must be allowed to expand. More heavy mud must be taken out of the well on top and replaced with an even higher surface pressure to compensate for the heavy mud being exchanged with the lighter gas which now occupies an even greater part of the wellbore. In reality the surface pressure will continue to increase until gas reaches the surface and then being replaced by the heavy mud being injected into the well via the drill string. The surface pressure wills not disappear until the entire annulus of the well is filled with a sufficiently heavy mud that will balance the formation pore pressure and that there is no more gas influx present in the well.

With this new invention, for as long as the gas is allowed to be separated from the drilling fluid/mud inside the marine drilling riser or in a separate auxiliary line/conduit and that the initial drilling fluid level is sufficiently low as indicated in FIG. 6, it will be possible to circulate out a gas kick under constant bottom hole pressure (equal to or above the formation pressure) without applying any pressure to the drilling riser or the choke line or choke at surface.

This can be seen from FIG. 6. A certain amount of gas (gas 1) has entered the well bore and occupies a certain height. This has pushed the drilling fluid/mud level to a new height (level 1). As gas is circulated out under constant bottom hole pressure by pumping drilling mud down drill pipe and up the drill pipe/wellbore annulus, the gas bubble is transported higher up in the well (gas 2) where the gas will expand due to a lower pressure. This increases the volume and hence pushes the drilling fluid in the riser to a new level (level 2). As circulation progresses (gas 3) will be even higher occupying and even larger volume hence pushes mud riser level to level 3.

This will continue until the gas is separated in the riser and vented to surface under atmospheric pressure. As gas is separated and heavy fluid is taken its place, the level will again fall back to the original level (level 0) or slightly higher to prevent new gas from entering the wellbore. In this way it is possible to circulate out a gas influx from deeper formations at constant bottom hole pressure without observing or applying pressure at surface or without having to close any valves or BOP elements in the system. This will greatly improve the safety of the operation and reduce the pressure requirements of risers and other equipment and can be performed dynamically without any interruption in the drilling process or pumping/circulation activity. The bottom hole pressure is simply kept constant with regulation of the liquid mud level within the marine drilling riser.

A variation to this method and procedure is to pump the influxes up the wellbore annulus to a height close to the seabed or riser outlet, then shut down the pumping process completely or to a very low rate, while adjusting the mud level accordingly to keep bottom hole pressure constant, equal to or slightly above the maximum pore pressure and letting the influx raise by gravity separation under constant bottom hole pressure without the need for any interference to the process. This can be an improvement to other known well control processes since experience has shown that it can be very difficult to keep constant bottom hole pressure hen the gas reach the surface and gas must be exchanged with mud and pressure regulation in the wellbore. Now for the first time this process will take place without the need for large surface pressure regulations.

One general aspect of the present invention is a subsea drilling method that includes pumping drilling fluid down into a borehole through a drill string and returning the drilling fluid back through an annulus, said annulus being formed between the drill string and the well bore, and between the drill string and a drilling riser surrounding the drill string above the seabed. The method further includes draining drilling fluid out of the drilling riser at a level between the seabed and the sea surface through an outlet to a subsea mud lift pump that is fluidly connected to a mud processing plant above the sea surface, thereby creating a drilling fluid interface below the sea surface between the drilling fluid in the annulus within the drilling riser and either gas or liquid extending in the annulus above the drilling fluid, a height of the drilling fluid interface thereby controlling and regulating a pressure of the drilling fluid in the annulus within the wellbore. In addition, the method includes providing a wiper or rotary closing element to seal off the annulus between the drill string and the riser above the outlet, and venting gas from the riser to a gas destination at atmospheric pressure.

In embodiments, a seabed BOP is kept open to allow fluid communication between the well and the riser. In some embodiments, said wiper or rotary closing element is arranged above said interface. In other embodiments, said interface, and hence said pressure of said drilling fluid in the annulus, is controlled by regulating the pump rate of said lift pump.

In certain embodiments, a seabed BOP is closed and fluid communication between the well and the riser is provided through a bypass line. And in various embodiments, a continuous circulation system is used in combination with a circulation and drilling method.

In embodiments, additional fluid other than the drilling fluid supplied through the drill string is supplied into the wellbore upstream of a choke valve, thereby improving the regulation of the pressure of the drilling fluid in the annulus within the wellbore.

In exemplary embodiments, additional fluid is supplied through a booster line upstream of the subsea lift pump to avoid settling of formation particles from the drilling fluid. In various embodiments a combined hydrostatic and dynamic pressure at a specified depth in the wellbore is kept constant during a drilling process by regulation of the height of the drilling fluid interface in the annulus within the drilling riser.

And some embodiments further include using an inert gas to purge the drilling riser.

Another general aspect of the present invention is a method for emergency disconnection of a marine drilling riser from a subsea well. The method includes lowering an interface in the drilling riser between drilling mud and gas or liquid above the drilling mud by using a subsea lift pump to evacuate drilling mud through an outlet from said riser, a pressure inside the riser at a disconnection point being thereby reduced below a corresponding seawater pressure, and continuing to operate said subsea lift pump and to evacuate said drilling mud while disconnecting said riser from said subsea well at said disconnection point.

In embodiments, the method further includes continuing to operate said subsea lift pump at least until said operation of said subsea lift pump no longer results in further evacuation of said drilling mud.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIG. 3.1 illustrates a drilling mode where any background gas or gas influx from the formation is separated and vented through the riser, diverter/rotating head and diverter line and liquid is pumped through pump outlet to the surface;

FIG. 3.2 illustrates well circulation with gas/fluid separation, diverting fluid and gas from below the BOP via the riser to the Subsea Lift Pump;

FIG. 3.3 illustrates well circulation without gas separation, diverting fluid and gas from below the BOP directly to the Subsea Lift Pump;

FIG. 3.4 illustrates an arrangement of drilling system with subsea lift pump (LRRS);

DETAILED DESCRIPTION

Figure 1A:
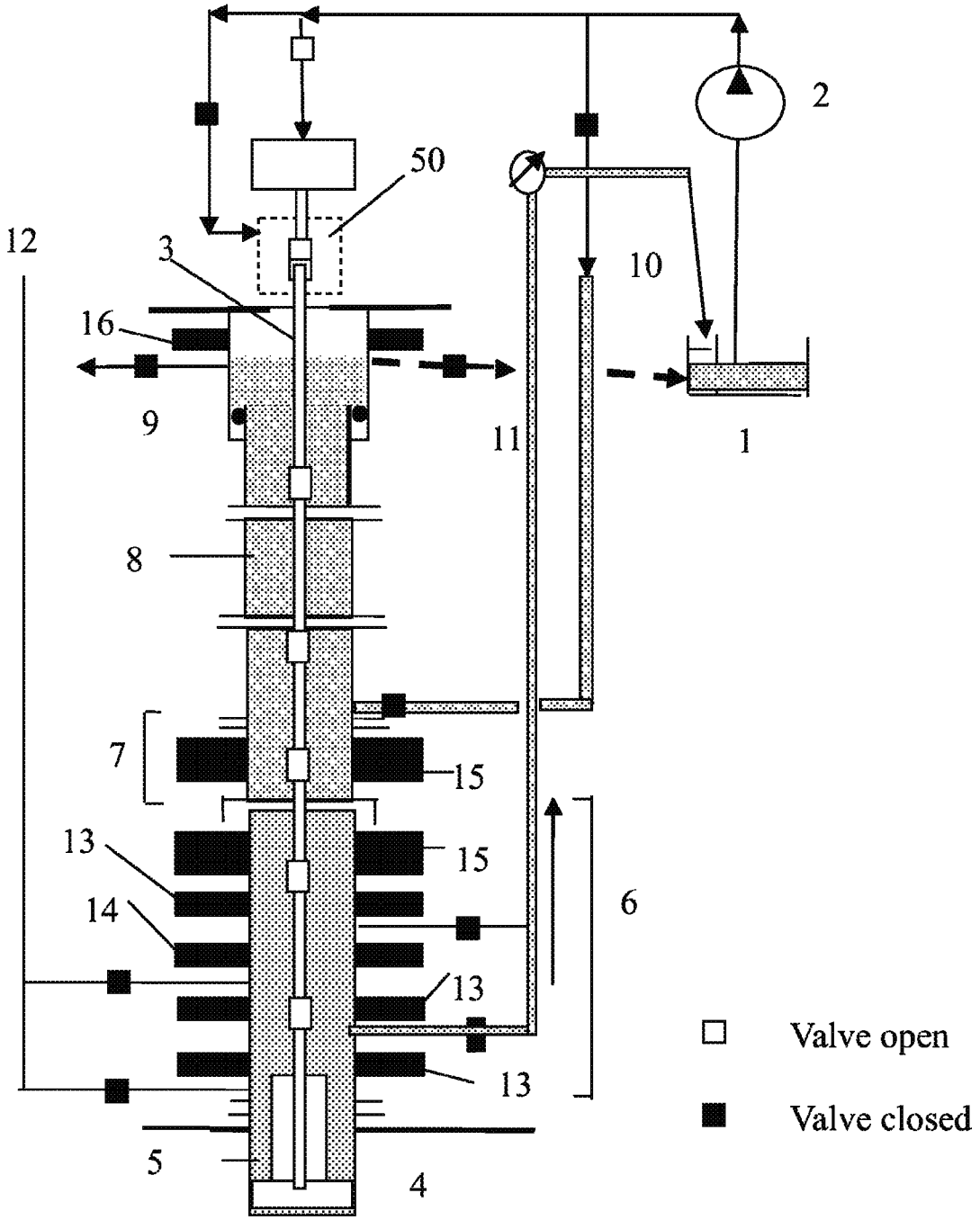
Fig. 1A (Prior Art)
FIG. 1A illustrates a typical arrangement of conventional subsea drilling system under normal drilling.

FIG. 1A illustrates a typical arrangement for subsea drilling from a floater. Mud is circulated from mud tanks (1) located on the drilling vessel, trough the rig pumps (2), drill string (3), drill bit (4) and returned up the borehole annulus (5), through the subsea BOP (6) located on the sea bed, the Lower Marine Riser Package (LMRP) (7), marine drilling riser (8), telescope joint (9) before returning to mud processing system through the flow line (17) by gravity and into the mud process plant (separating solids from drilling mud not shown) and into the mud tanks (1) for re-circulation. A booster line (10) is used for increasing the return flow and to improve drill cutting transport in the large diameter marine drilling riser. The high pressure choke line (11) and kill line (12) are used for well control procedures. The BOP, typically has variable pipe rams (13) for closing the annulus between the BOP bore and the drill string, and shear ram (14) to cut the drill string and seal the well bore. The Annular preventers (15) are used to seal on any diameter of tubular in the borehole. A diverter (16) located below drill floor is used for diverting gas from the riser annulus through the gas vent line (18). This element is seldom used in normal operations. A continuous circulation device (50) might be used and allows mud circulation through the entire well bore while making drill string connections. This system avoids large pressure fluctuations caused when pumping and circulation is interrupted every time a length of new drill pipe is added or removed to/from the drill string.

Figure 1B:
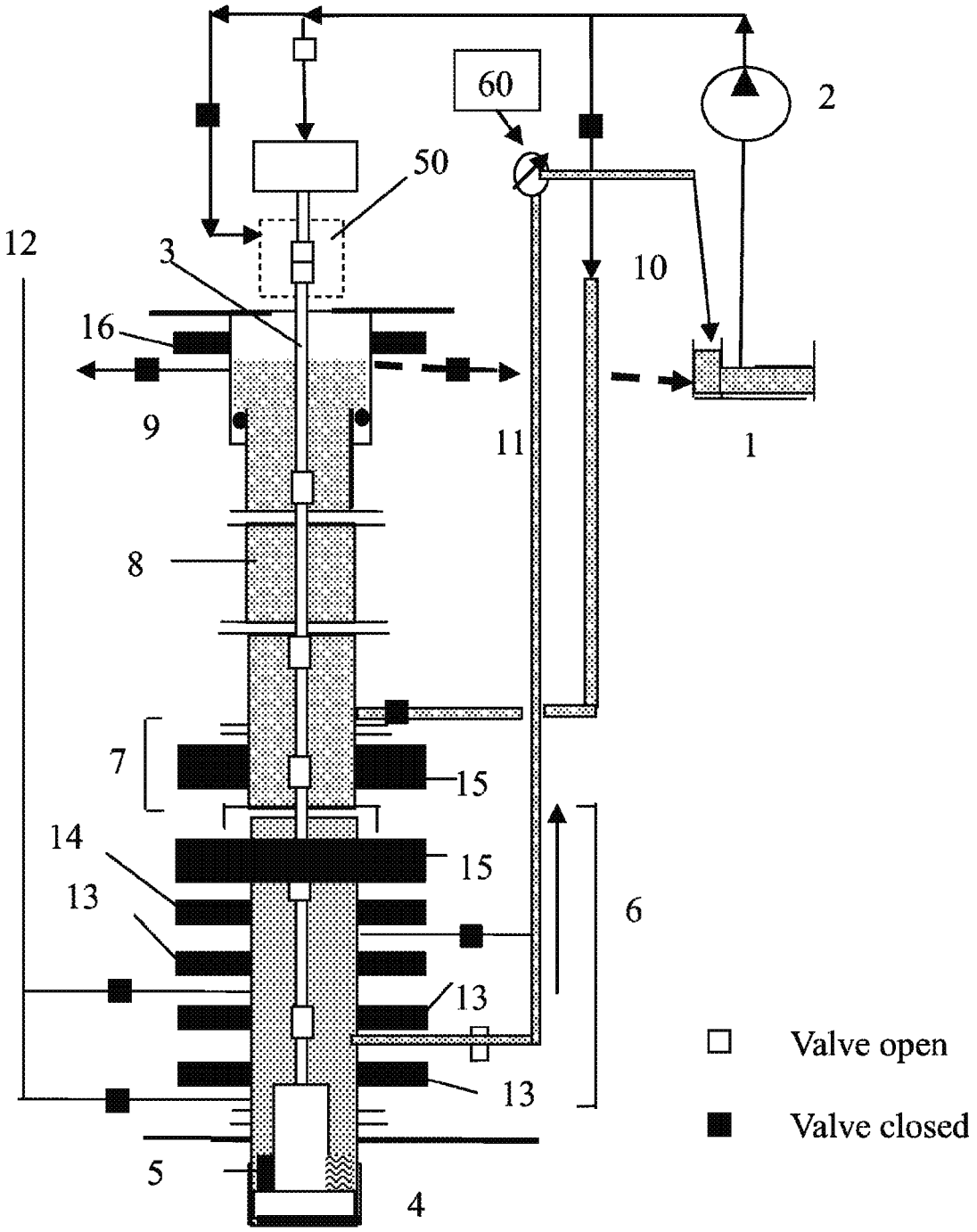
Fig. 1B (Prior Art)
FIG. 1B illustrates a typical arrangement of conventional subsea drilling system under well control event requiring closed BOP system.

Generally, two independent pressure barriers between the reservoir and surroundings are required. Primary barrier is the drilling fluid and the secondary barrier is the drilling subsea BOP. FIG. 1B visualizes the circulation path during a conventional well control event. A gas has entered the borehole in the bottom of the well and displace out an equivalent same amount of heavy fluid on top of the well as indicated in an increased volume of drilling mud in the return tanks (1) on surface. To compensate for this fall in bottom hole pressure the well must be closed in, i.e. the drilling is stopped, and the pressure regulated by the choke valve (60) on top of the choke line 11. As gas is pumped or circulated out of the hole the gas will expand and push even more heavy fluid out of the well into the mud tank 1, which has to be compensated for by applying even more pressure on top of the well by help of the choke valve 60. In this way the well control event will require considerably high pressures applied to the top of the well and therefore requiring the choke line to be of high pressure rating.

Figure 2:
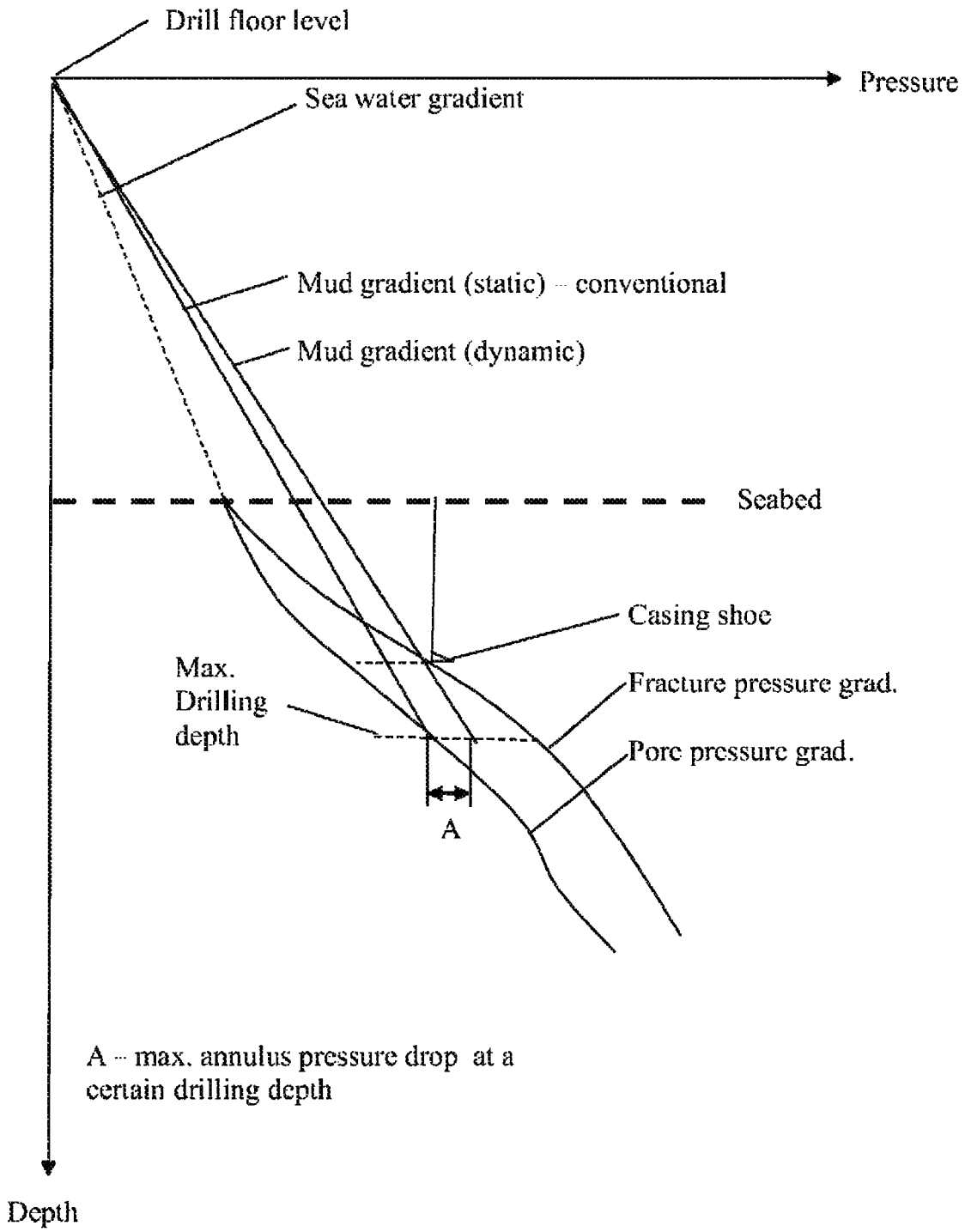
Fig. 2 (Prior Art)
FIG. 2 illustrates an allowable annulus pressure drop for conventional drilling.

FIG. 2 illustrates typical mud pressure gradients and the maximum allowable pressure variation (A) at a selected depth in a bore hole due to the pressure variation between hydrostatic and hydrodynamic pressure (equivalent circulating density (ECD)). The pressure barriers are the column of drilling fluid and the subsea BOP. When disconnecting the riser from the BOP, the pressure barriers are the BOP and the hydrostatic head consisting of the column of mud in the borehole pluss the pressure from the column of seawater. Generally, riser margin is hard to achieve with a narrow mud window (low difference between the pore pressure and the fracture pressure in the formation). This is often the case in deep waters.

Low Riser Return System (LRRS)

General

In order to improve drilling performance, Managed Pressure Drilling (MPD) has been introduced. One method of MPD is the Low Riser Return System (LRRS), where a higher density mud is used than in conventional drilling and a method to control the low mud level (typically below sea level and above seabed) with the help of a subsea pump and several pressure sensors.

One version of the LRRS system is illustrated in FIG. 3.1. Mud is circulated from mud tanks (1) located on the drilling vessel, trough the rig pumps (2), drill string (3), drill bit (4) and returned up the borehole annulus (5), through the subsea BOP (6) located on the sea bed, the Lower Marine Riser Package (LMRP) (7), marine drilling riser (8), Mud is then flowing from the riser (8) through a pump outlet (29) to surface using a subsea lift pump (40) placed on or between the seabed and below sea level by way of a return conduit (41) back to the mud process plant on the drilling unit (not shown) and into the mud tanks (1). The level in the riser is controlled by measuring the pressure at different intervals by help of pressure sensors in the BOP (71) and/or riser (70). The air/gas in the riser above the liquid mud level is open to the atmosphere through the main drilling riser and out through the diverter line (17) and thereby kept under atmospheric pressure conditions. The riser slip joint (9) is designed to hold any pressure. A drill pipe wiper or stripper (120) is placed in the diverter element housing or just above and will prevent formation gas to ventilate up on the rig floor. Hence regulating the liquid mud level up or down in the marine drilling riser will control and regulate the pressures in the well below.

Any gas escaping from the subsurface formation and circulated out of the well will be released in the riser and migrate towards the lower pressure above. The majority of the gas will hence be separated in the riser while the liquid mud will flow into the pump and return conduit which is full of liquid and hence have a higher pressure than the main riser bore. For relatively smaller amount of gas contents it will not be necessary to close any valves in the BOP or well control system to operate under these conditions. Pressure in the well is simply controlled by regulating the mud liquid level. Since the vertical height of the drilling fluid acting on the well below is lower than conventional mud that flow to the top of the riser, the density of the drilling fluid in the LRRS is higher than conventional. Hence the primary barrier in the well is the drilling mud and the secondary barrier is the subsea BOP.

Figure 4:
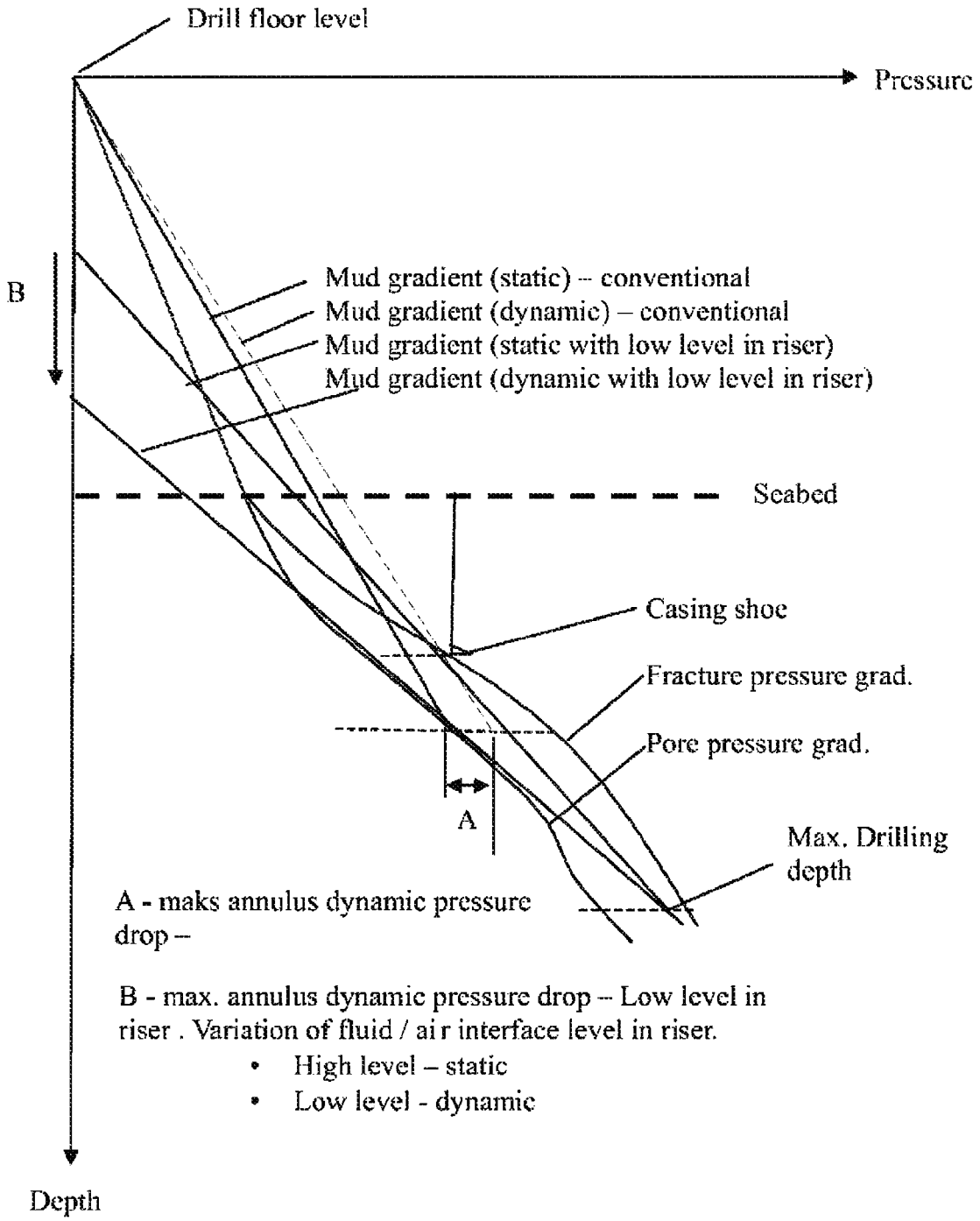
FIG. 4 illustrates allowable annulus pressure loss for conventional drilling vs. single gradient drilling using low fluid/air level in marine drilling riser (LRRS)

Allowable annulus pressure loss for conventional drilling vs. single gradient drilling using low fluid level in the marine drilling riser is illustrated in FIG. 4. High level of drilling fluid in the riser controls the borehole pressure in static condition (no flow through the annulus of the bore hole). During circulation, the fluid level (41 in FIG. 3.1) in the marine drilling riser is lowered by the subsea pump in order to compensate for the annulus pressure loss (increased bottom hole pressure), thus controlling the bore hole pressure. This can be illustrated by B in FIG. 4.

The primary barrier in place is the column of drilling fluid and the secondary barrier is the subsea BOP. Depending on the pressure conditions in the formation, etc., a riser margin may be achieved. With a low fluid level in the marine drilling riser the fluid vertical height which exerts hydrostatic pressure in the bore hole is lower than when the drilling fluid level is at surface. Hence the fluid weight (density) is higher than when the drilling fluid (mud) level is at surface to have equal pressure in the bottom of the borehole. This means that the density of the drilling fluid in this case is so high that it would exceed the formation fracture pressure if the level of the fluid in the riser reached the surface or flow line level of conventional drilling. Hence even with a considerable gas influx at the bottom of the well, the formation would not withstand a drilling mud fluid level at flow line level (17 FIG. 1A)

Figure 5:
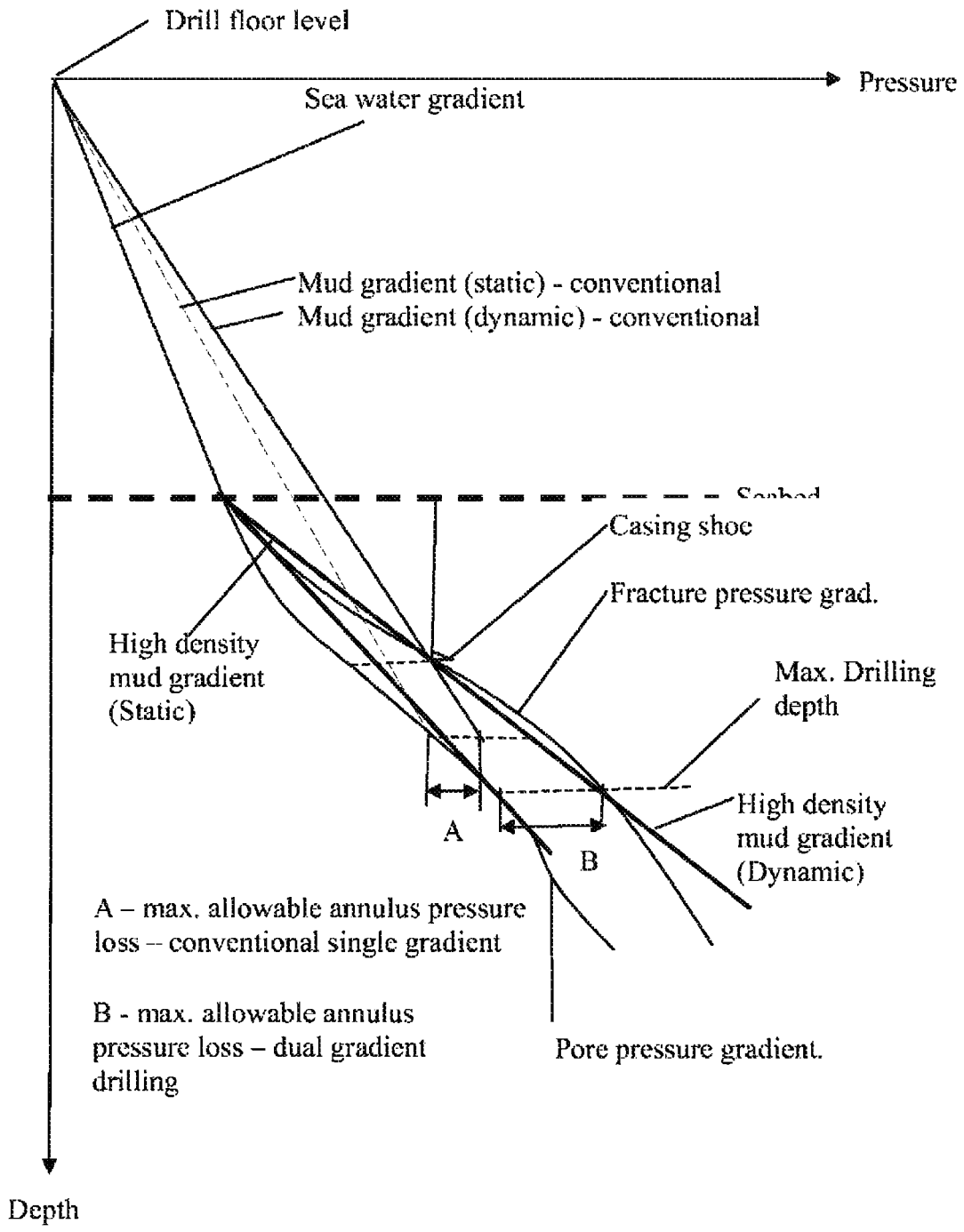
FIG. 5 illustrates allowable annulus pressure loss for conventional drilling vs. drilling with dual fluid (seawater in riser) and drilling fluid below.

Alternatively, the borehole can be filled with a high density mud in combination with a low density fluid, i.e., sea water in the upper part of the marine drilling riser as illustrated in FIG. 5. The primary pressure barrier is now the column of drilling fluid and the seawater fluid column combined and secondary barrier is the subsea BOP. Depending on the pressure, etc., riser margin will be more difficult to achieve compared to the case above with a low mud level in the riser and gas at atmospheric pressure above.

One important issue using the dual gradient compared to the single gradient system (LRRS) is the handling of large and high gas flow into the borehole from the subsurface formation (kicks).

Method for Gas Kick Handling

Generally, the subsea BOP is typically rated for 10 000 or 15 000 Psi while the riser and riser lift pump system are rated for low pressure, typical 1000 Psi. Therefore, high pressure fluids should not be allowed to enter the riser and/or subsea mud lift pump system. Another limitation of the subsea mud lift pump is the limitation for handling fluids with a significant amount of gas. So, for increased efficiency, the majority of gas should be removed from the drilling fluid before entering the pump. For the same reason the gas can not be allowed to enter the riser if it is filled with drilling mud or liquid to the surface as in conventional drilling or with dual gradient drilling, since it would create an added positive pressure on the riser main bore (8). Since the main drilling riser can not resist any substantial pressure, this can not be allowed to happen in order to remain within the safe working pressure of the marine drilling riser (8) and slip joint (9).

Due to the high density of the mud in use and the low mud level in the riser, conventional choke line and surface choke manifold can not be used for well kick circulation. A fluid column all the way back to surface will most likely fracture the formation of the borehole because this new process use mud of much higher density than when the mud flows back to the drilling installation on surface as in conventional drilling.

A possible solution to the above mentioned limitations is to introduce a tie-in to the marine drilling riser main bore (39) as illustrated in FIG. 3.1, from the choke line (11) with the option to also include a subsea choke valve (101) and the installment of several valves (102) and (103), the tie-in and inlet to the marine drilling riser being above/higher than the outlet to the subsea mud pump (29) below. In case of a large gas volume entering the bore hole illustrated in FIGS. 3.2 and 3.3, the BOP (6) is closed and the mud and gas (35) is circulated out of the wellbore annulus into the choke line 11 by opening the valves (20) and (102) and then into the marine drilling riser above the outlet to the pump, with the option to flow through a subsea choke valve (100) and into the marine drilling riser (8), preferably at a level (39) above the level for the pump outlet (29). Due to the low density of gas, the gas will move upwards towards lower pressure in the marine drilling riser and can be vented to the atmosphere at ambient atmospheric pressures using the standard diverter (16) and diverter line (18 in FIG. 3.2). The high density drilling fluid (mud) will flow towards the pump outlet (downwards) (29) and into the suction line through valves (28) and (27) to the subsea lift pump (40). The optional choke valve 101 allows the fluid flow to be reduced/regulated in order to achieve an effective mud—gas separation in the riser. The arrangement hence removes gas or reduces the amount of gas entering the pump system. The subsea chokes can be placed anywhere between the choke line outlet on the subsea BOP and inlet to the marine drilling riser 39.

An alternative is to divert the fluid and gas from the choke valve (101) directly to the pump (40) via valve (110) as illustrated in FIG. 3.3. In this case the drilling fluid and the gas are diverted through the pump (40) to surface without separation. Valves (102) (27) (28) will then be closed. The riser may now be isolated.

Using a continuous circulation system (50), the fluid flow through the drill string and annulus of the bore hole can be kept constant during drill pipe connection. Otherwise the fluid level in the riser would have to be adjusted when making drill pipe connection in order to keep constant bottom hole pressure during a connection (adding a new stand of drill pipe).

During a gas kick circulation, the bottom hole pressure is maintained as the gas in the borehole expands on its way to surface simply by increasing the fluid head in the riser or an auxiliary line. As long as the fluid head is lower than the manageable fluid level in the riser (the fluid must not flow to the mud tank (1)).

For normal drilling operation, it is expected that the volume of gas in the return fluid from the well is limited and can be handled through the subsea riser mud lift pump. Some of the gas will be separated in the riser and diverted using a wiper element or Rotating BOP (120), or a standard diverter element (16), through the vent line (18) as illustrated in FIG. 3.1.

The subsea choke valve allows for low mud pump circulation rates since pressure in the annulus is regulated by the choke pressure. This option allows more time for the gas and mud to separate in the riser (more controllable). However, subsea chokes are more complicated to control compared to surface chokes due to the remoteness. Replacement of the choke valve and plugging of the flow bore in the choke, are challenges. One option is to install two chokes in parallel. A further option is to pump additional fluid into the well bore using the kill line (12). Higher flow from the borehole and kill line requires larger opening of the choke valve and the likelihood for plugging is thus reduced. Also the pressure drop will be easier to control with a higher flow rate through the choke valve. Using a small orifice (fixed choke) instead of a variable remotely controlled valve/choke might be an option.

Also the booster line could be used to avoid settling of formation cuttings in the riser annulus between the closed subsea BOP and the outlet to the subsea pump. Hence it will be possible to mange the mud level in the riser upwards and use the subsea pump to regulate the level down. Managing the riser level up or down to control the annular well pressures between the closed BOP is also an option.

The choke valve can be located on the BOP level, or in the choke line between the BOP and inlet to the riser (39) as illustrated in FIG. 3.1. Location of the choke valve close to the inlet (39) will not affect the conventional system in case of plugging the choke, etc.

An alternative embodiment of a LRRS system according to the present invention is illustrated in FIG. 3.4. Mud circulation from the annulus is flowing trough an outlet (35) in the riser section (36) below an annular seal (37) to a separator (38) where mud and gas are separated. The gas is vented through a dedicated line (39) to surface. A pump 40 is used to bring return mud to surface for processing and re-injection. During well circulation, the fluid/air level (41) in the riser (8), and the fluid/air level (42) in the vent line (39) are the same.

Figure 4A:
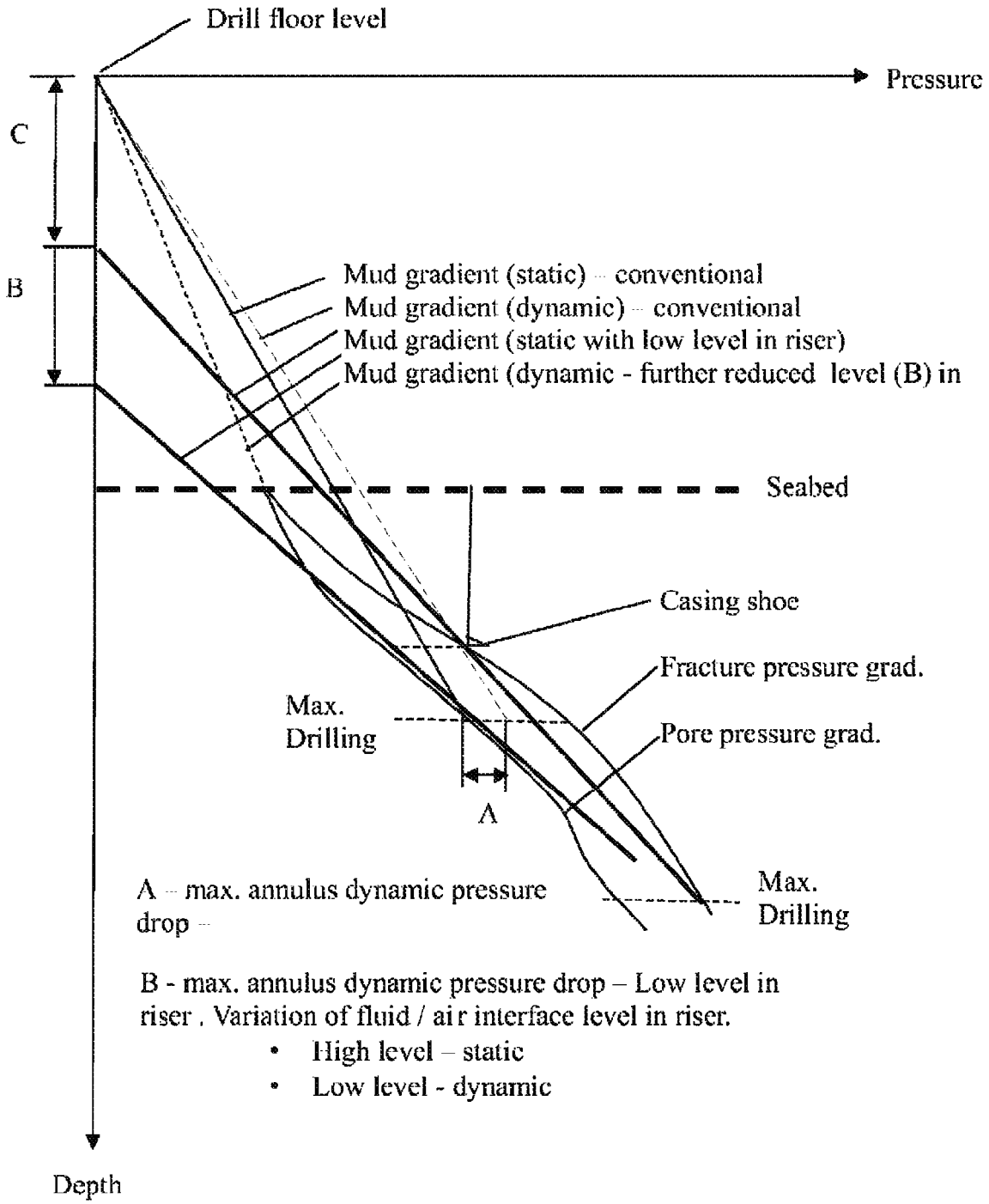
FIG. 4A illustrates allowable annulus pressure loss for conventional drilling vs. single gradient drilling using low fluid/air level in marine drilling riser (LRRS)

Allowable annulus pressure loss for conventional drilling vs. single gradient drilling using low fluid level in the marine drilling riser (LRRS) is illustrated in FIG. 4A. Using the LRRS method, a more heavy drilling fluid and a lower mud/air level (C) in the riser can be used. In static condition (no mud circulation), the mud gradient is limited by the fracture at the casing shoe. When mud circulation starts (dynamic condition), the mud/air interface in the marine drilling riser is further reduced, but not below the pore pressure gradient below the casing shoe. The pressure barriers in place are the column of drilling fluid and the subsea BOP. Depending on the pressure conditions, etc., riser margin may be achieved.

Figure 5A:
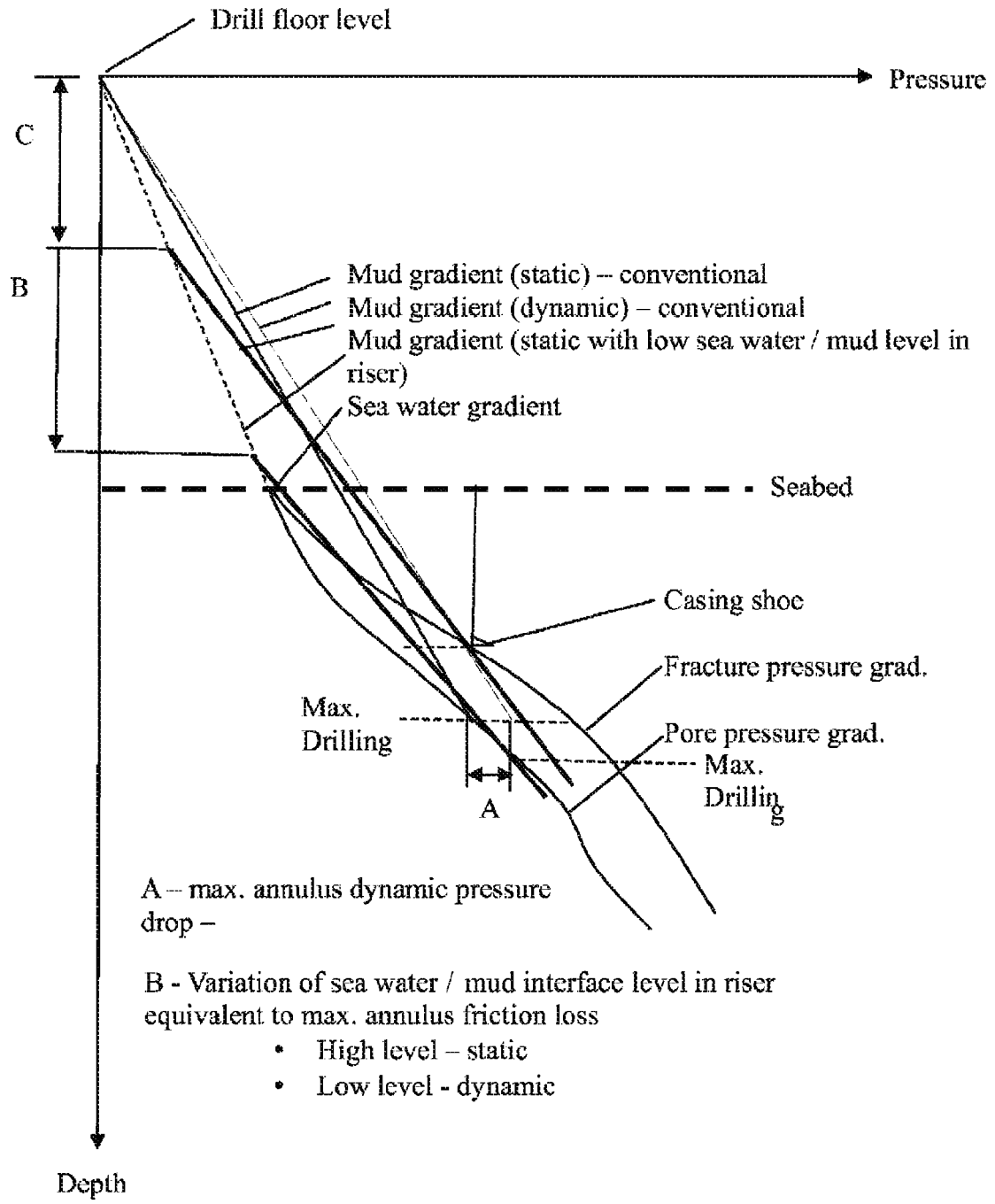
FIG. 5A illustrates allowable annulus pressure loss for conventional drilling vs. drilling with low sea water/mud level in riser.

Alternatively, the borehole can be filled with a high density mud in combination with a low density fluid, i.e., sea water in the upper part of the marine drilling riser as illustrated in FIG. 5A. In static condition (no mud circulation), the mud gradient is limited by the fracture pressure at the casing shoe. When mud circulation starts (dynamic condition), the mud/sea water interface in the marine drilling riser is reduced, but not below the pore pressure gradient below the casing shoe. The primary pressure barriers are the column of drilling fluid plus sea water and the secondary barrier is the subsea BOP. Depending on the pressure, etc., riser margin will be more difficult to achieve compared to the case above with air in the riser.

Figure 5B:
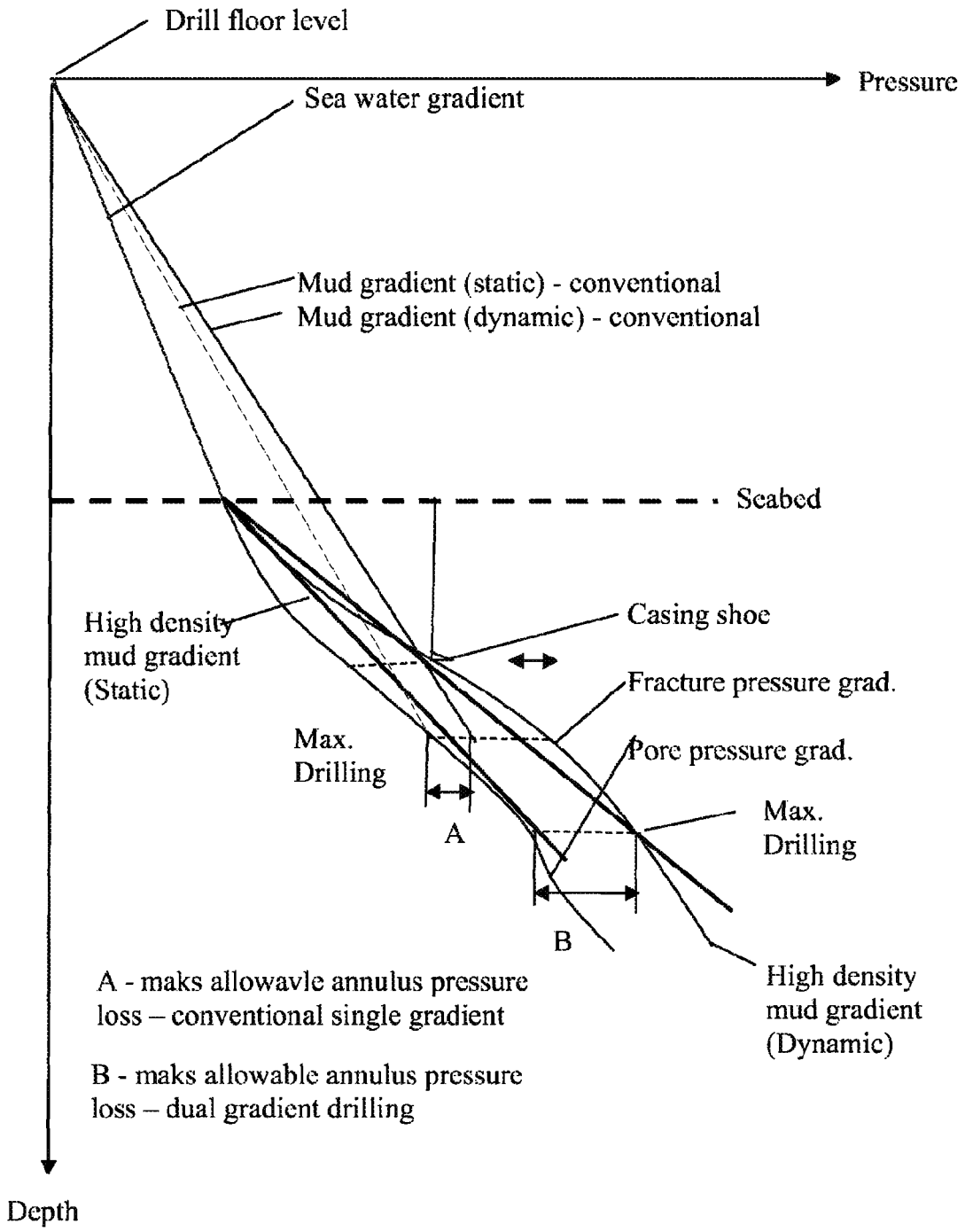
FIG. 5B illustrates allowable annulus pressure loss for conventional drilling vs. dual gradient drilling with seawater/mud level in the marine drilling riser.

Alternatively, the borehole can be filled with a high density mud in combination with a low density fluid, i.e., sea water in the marine drilling riser as illustrated in FIG. 5B (known as dual gradient drilling). In static condition, the mud gradient must be above the pore pressure gradient, and during circulation (dynamic condition), the mud gradient must be below the fracture pressure gradient. The pressure barriers are the column of drilling fluid and seawater from seabed (primary) and the subsea BOP (secondary). Depending on the pressure, etc., riser margin will be easier to achieve compared to case illustrated in FIG. 5A.

However the maximum drilling depth is achieved using the LRRS shown in FIG. 4 in this case.

Description of Different Modes of Operations with the LRRS Option 1

FIGS. 6A-11 illustrate different operational modes of the LRRS

Figure 6:
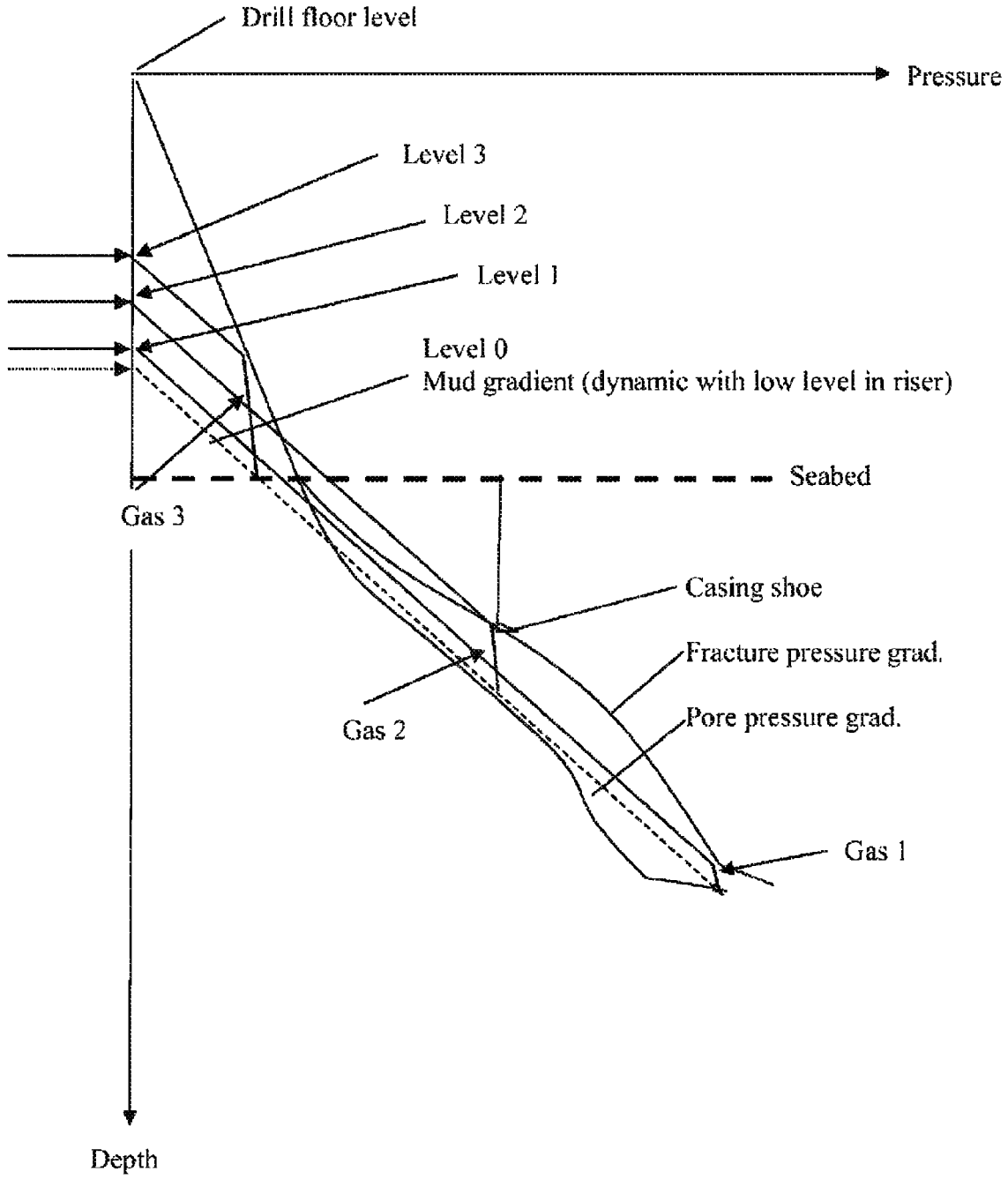
FIG. 6 illustrates how gas can be circulated out of a well with constant bottom hole pressure and separated in a riser without applying pressure at surface.
Figure 6A:
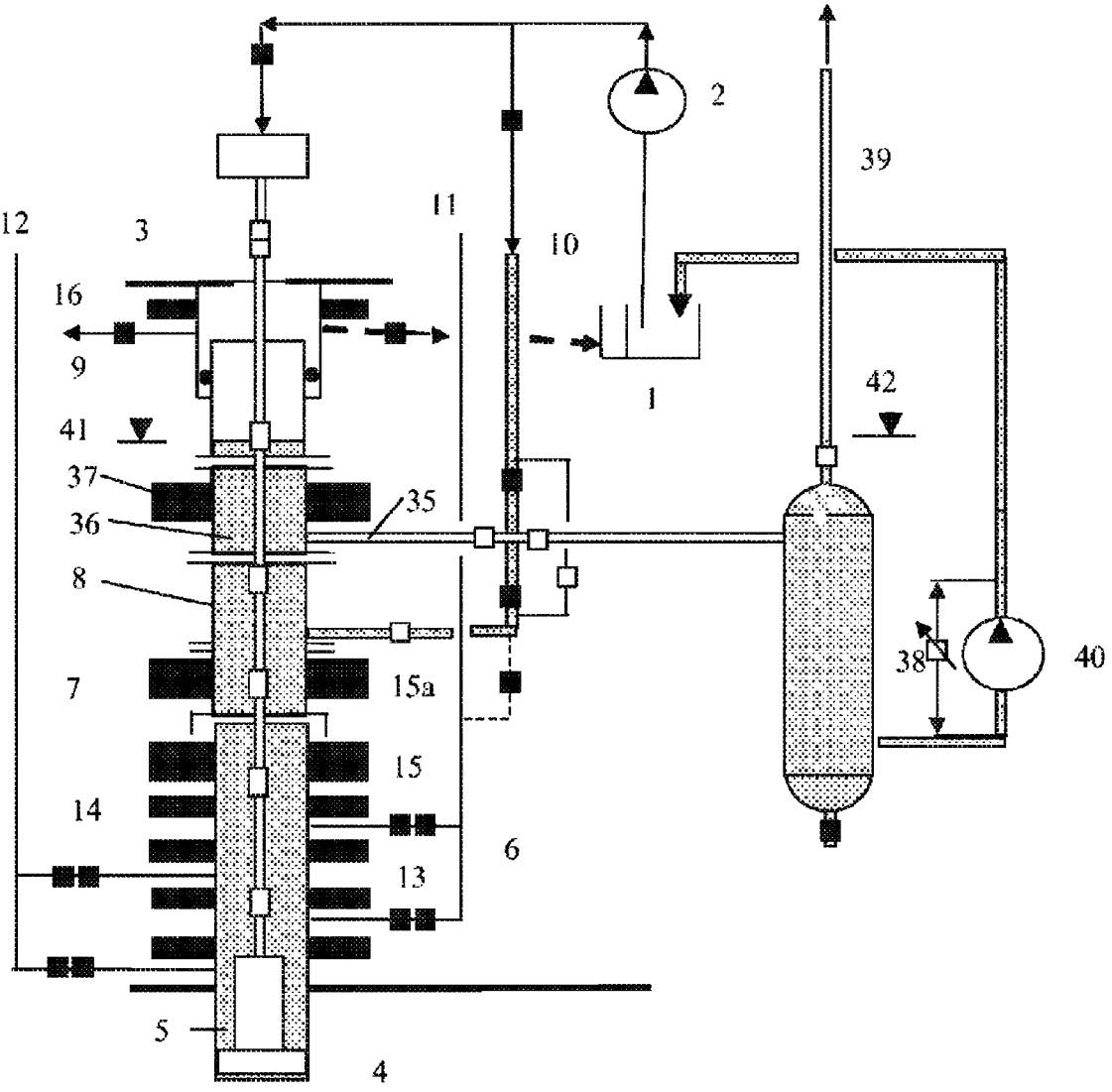
FIG. 6A illustrates Drilling Mode, with Annular seal (37) open.

Drilling Mode—Annular Seal (37) Open—FIG. 6A

Low mud level (41) and 42) in riser and auxiliary vent line (39), respectively. Mud return is via subsea lift pump (40). The fluid level in the riser/vent line dictates the bottom hole pressure (BHP). There is no closing element in the system. However, there is an option to have a wiper, stripper element (120) installed in the diverter element or above to keep drill gas released from the drill mud in the riser to enter the drill floor area or if an inert gas is used to purge the riser, this gas is diverted out through the diverter line.

Figure 7:
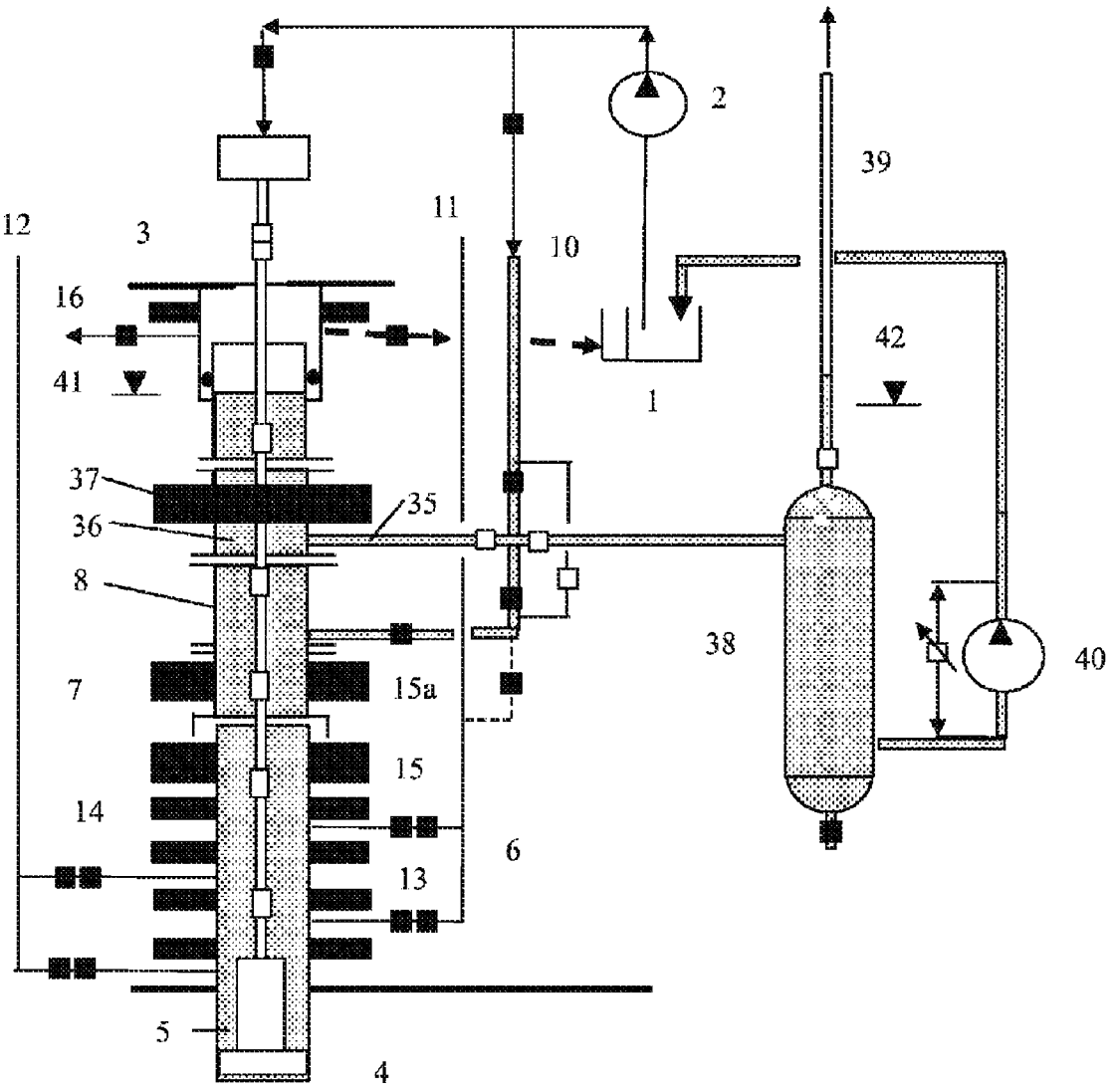
FIG. 7 illustrates Drill pipe connection mode, with Annular seal (37) closed.

Drill Pipe Connection Mode—Annular Seal (37) Closed—FIG. 7

This procedure and method is used in order to compensate for the reduction in wellbore annulus pressure when the pumping down drill pipe is stopped, as when making a connection of drill pipe.

In this situation there is a low mud level (41) in marine drilling riser (8) and a high mud level (42) in the vent line (39). Mud is return via the subsea lift pump. The level of drilling fluid is regulated in the much smaller auxiliary line, making the regulation process much faster and more efficient than having to regulate the level in the main marine drilling riser. The seal element in the riser will isolate the pressure above the seal element in the drilling riser and the wellbore pressures is now regulated by the level (42) in the auxiliary vent line.

Proper spacing of the annular seal (37) in the riser section in combination with long single drill pipe (15 m is standard) is preferred to avoid tool joint (TJ) passing through the closed BOP annular seal. BOP annular seal can handle TJ passing through, but the lifetime will then be reduced. Alternatively, a pup joint is used in the drill string for proper space out. When a pup joint is passing through the annular seal (37), a new pup joint is added to the drill string. The main benefit is that seal element will last longer when not activated permanently in the drilling operation when drilling and rotating. The element is only closed when not rotating and only during interruption in the circulating process.

The procedures for drill pipe connection will be as follows:

1. Stop rotation and space out drill string. Close Annular seal (37)
2. Ramp down rig pumps while subsea pump regulate the fluid/mud level in the vent line to compensate for loss of friction
3. Set slips
4. Add a new stand
5. Retrieve slips
6. Ramp up rig pump while fluid level in vent line is gradually reduced using the subsea lift pump to maintain constant BHP
7. When full circulation is achieved open annular seal (37)
8. Continue drilling The heave compensator is active except when the drill string is suspended in the slips to minimize wear on the annular seal (37) due to sliding of the drill pipe section through the sealing element.

Drill Pipe Connection Mode—Annular Seal Open FIG. 6A

The fluid level in the marine drilling riser (41) and vent line (42) is raised for making drill pipe connection. However, this is a time consuming process. It is required if the annular do not seal properly or is not installed. The riser will be filled also through the booster line, or kill line, etc.

The procedures for drill pipe connection will be as follows:

1. Fill up riser using riser booster line while rig mud pumps (2) are ramped down to compensate for loss of friction
2. Set slips
3. Add a new stand
4. Retrieve slips
5. Ramp up rig pump while fluid (mud) level in vent line 39 and marine drilling riser are gradually reduced using the subsea lift pump to maintain the BHP.
6. When full circulation, commence drilling Circulating Kick Using Subsea Lift Pump—FIG. 8.

Figure 8:
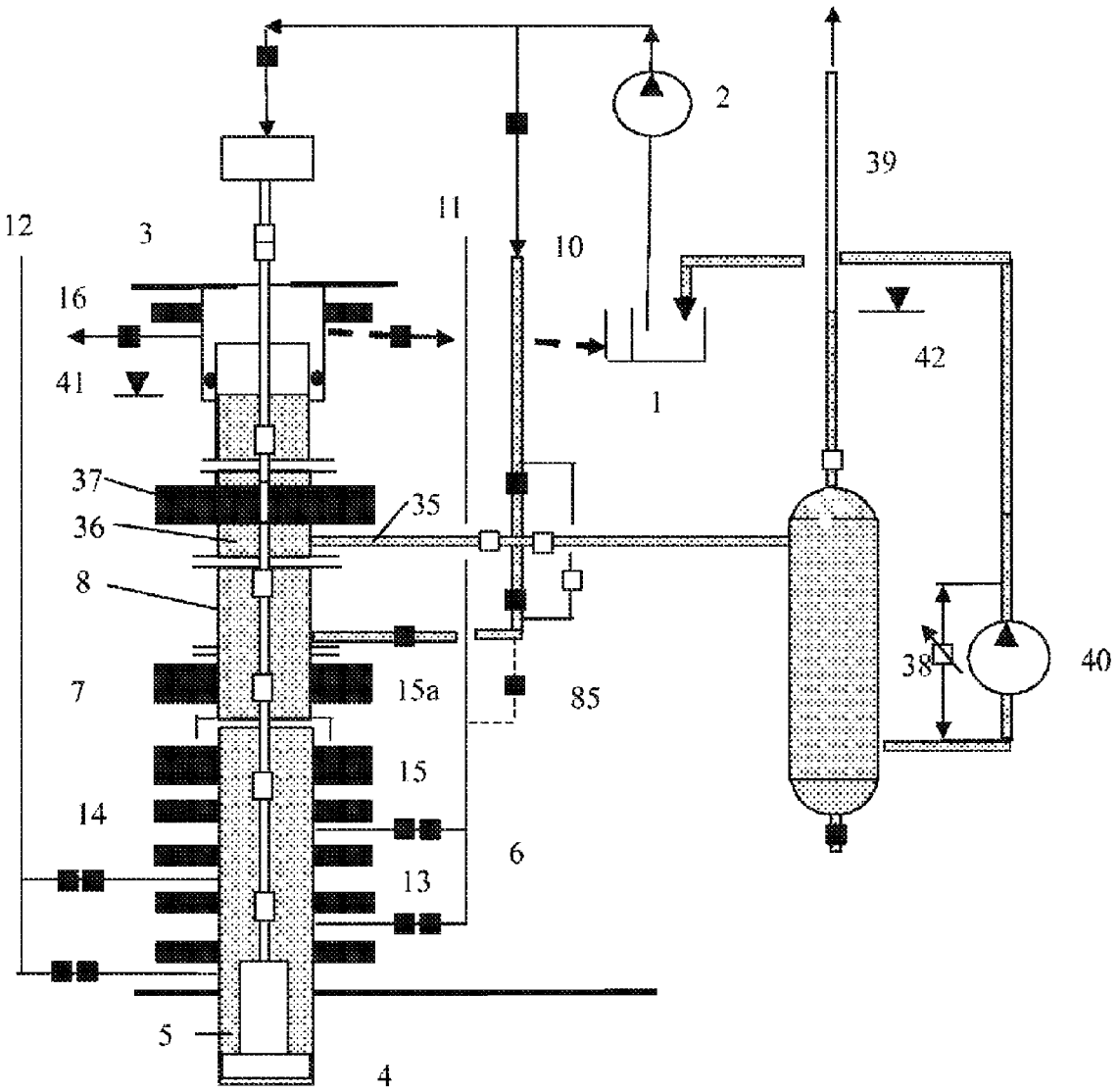
FIG. 8 illustrates Circulating kick using subsea lift pump, with Annular seal (37) closed.

In this situation the riser annular seal is closed (see FIG. 8).

As long as the fluid level (42) in the vent line (39) is below surface, the gas kick is circulated out of the well using the annular seal (37) and the lift pump (40).

The procedures for gas kick circulation will be as follows (modified drillers method):

1. Close Upper annular seal (37)
2. Continue circulating while increasing the fluid level in the vent line (39)

3. Measure pressure (from PWD) and adjust fluid head in vent line to maintain BHP above the new pore pressure
4. Alternative 1A: Reduce pump rate to static while adjusting level in vent line to keep BHP constant. When static, observe well while monitoring fluid level/pressure in vent line
5. Start rig pump and adjust subsea lift pump to maintain constant BHP.
6. Circulate out kick while keeping drill pipe pump pressure (DPP) constant while regulating vent line level.

The gas from the subsea separator is diverted into the open vent line which is used to balance the BHP. In case of a larger gas influx, the hydrostatic column of drilling fluid in the vent line is increased until balance is achieved. As the gas is circulated out of the bore hole and expanded, the hydrostatic head in the vent line is increased.

There are several more methods or procedures that can be followed without diverging from the embodiments of the invention The separated fluid is diverted through to the subsea lift pump. The subsea lift pump should not be exposed to high pressure mainly due to the low pressure suction hose, return hose and separator, etc. If high pressure is expected due to a large column of gas in the bore hole, the vent line (39) may be completely filled. In this case, the subsea lift pump and separator must be by-passed and isolated. Well circulation and well killing can then performed using the conventional well control equipment and procedures, i.e., pipe ram (13) in the subsea BOP closed and return fluid through choke line (11) and surface choke manifold. However this can be achieved only if the formation strength of the open hole section will allow this procedure to be performed. In the end of well control operation, the required hydrostatic head will be reduced and further well circulation operation can take place using the lift pump and a low mud7air interface level in one of the auxiliary lines.

Figure 9:
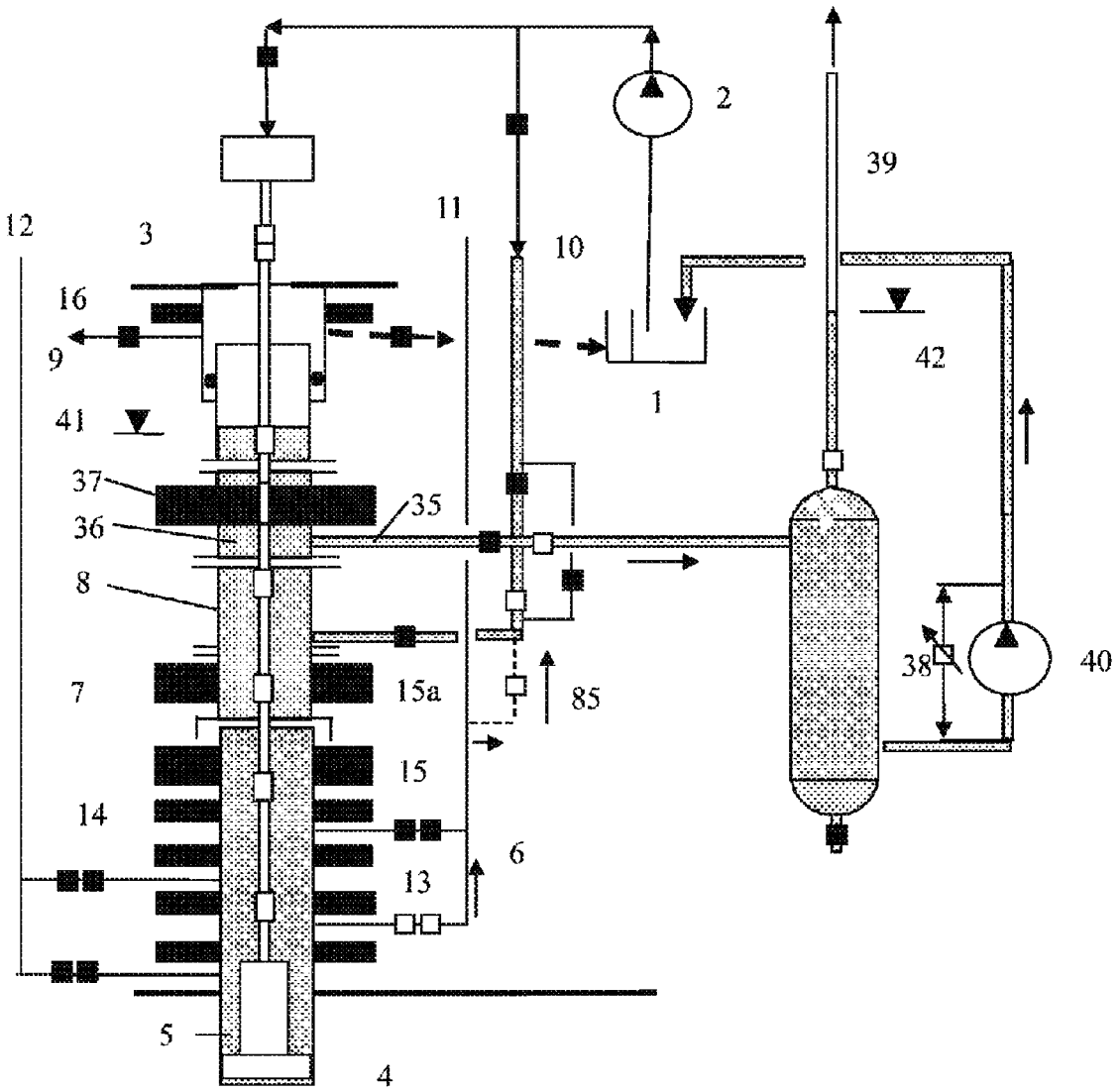
FIG. 9 illustrates Circulating kick using subsea lift pump with BOP pipe ram closed.
Figure 10:
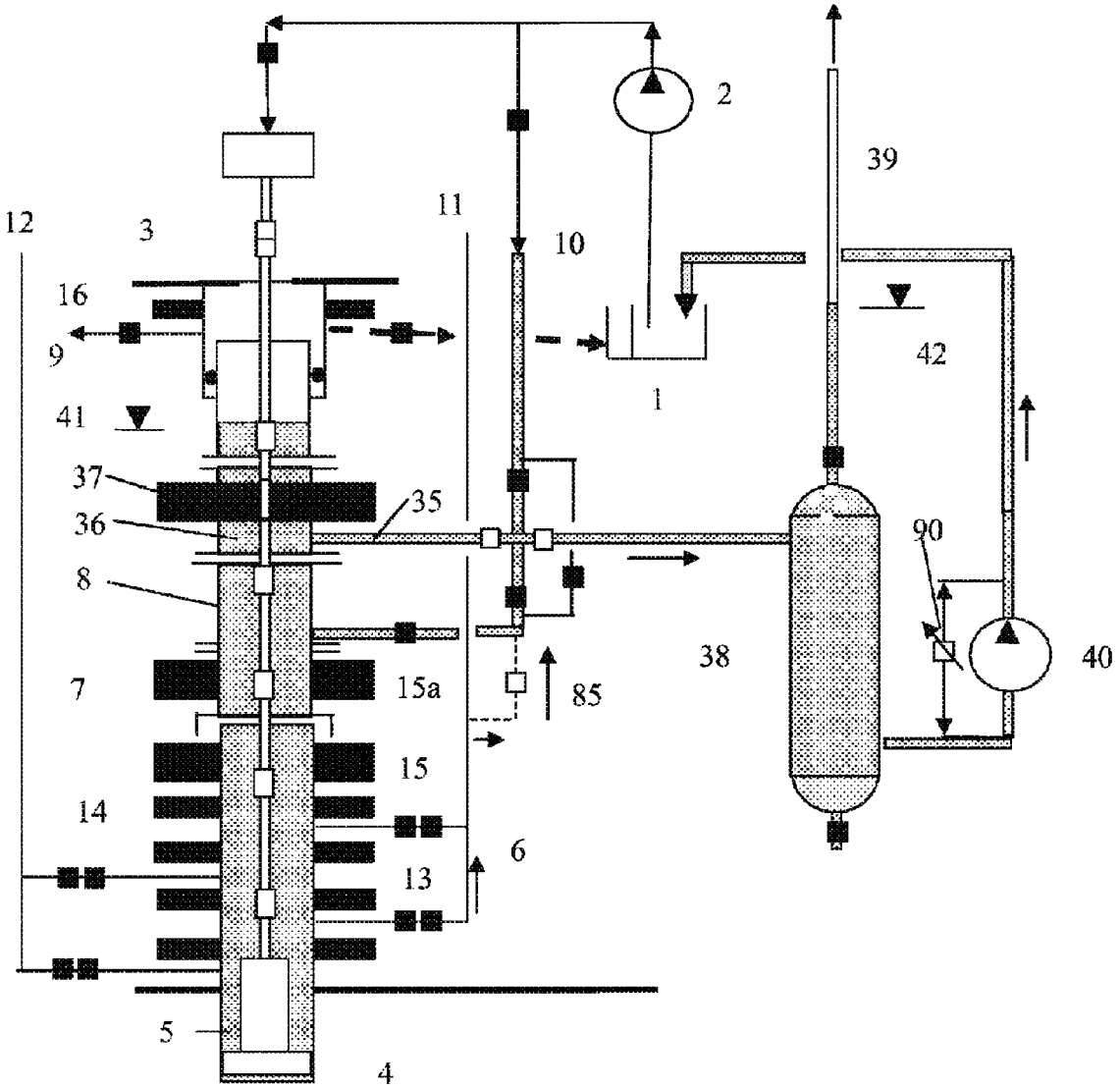
FIG. 10 illustrates Arrangement for Surge and swab pressure compensation, Drill pipe connection mode, with Annular seal (37) closed.

One option would be to use a pipe ram (13) or annular preventer (15) in the subsea BOP (6) when circulating a small gas kick through the pump. In this case, communication valve (85) to the separator and lift pump is open as illustrated in FIG. 9.

Surge and Swab Pressure Compensation. Drill Pipe Connection Mode—Annular Seal (37) Closed—FIG. 10

Vent line (39) closed. Mud return via subsea lift pump. Surge and swab pressure fluctuation due to rig heave can be compensated for using the subsea lift pump with bypass to a choke valve (90).

The procedures for compensating for surge and swab pressure would be;

1. Start the subsea lift pump with the subsea bypass valve (85) partly open to maintain pressure on the suction side of the pump
2. For swab pressure compensation—Increase opening of the subsea bypass choke valve (90) to allow hydrostatic pressure from pump return line to be applied for pressure increase in the borehole
3. For surge pressure compensation—Reduce opening of the subsea bypass choke valve (90) to allow pump to reduce the pressure in the bore hole.

Compensating for surge and swab pressure is a challenge on a MODU. However, with proper measurements of the rig heave motion, and predictive control, this method will make it feasible.

Figure 11:
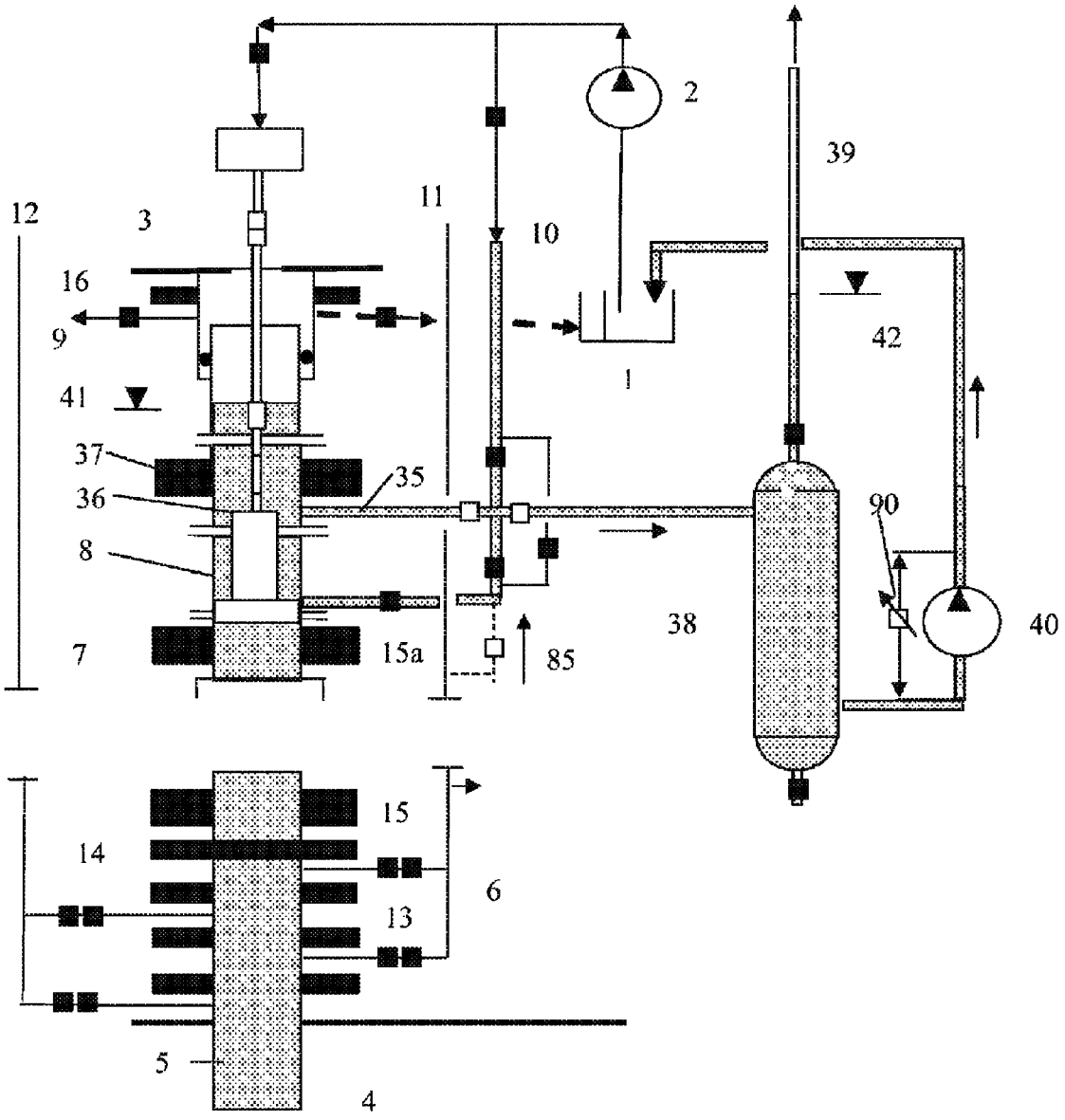
FIG. 11 illustrates Marine drilling riser, in Disconnected mode.

Disconnection of Marine Drilling Riser—FIG. 11

Disconnection of marine drilling riser takes place conventionally. All connections for the lift pump are above the riser connector.

In conventional drilling displacing riser and other conduits to sea water before disconnection will avoid spillage of drilling fluid to sea. In an emergency case, no time for fluid displacement is possible hence the fluid in the riser, etc., will be discharged to sea. With the LRRS system no spillage to the sea will normally occur. Since the pressure inside the marine riser at the disconnect point will be lower or equal to the seawater pressure, seawater will flow into the riser and hence the entire drilling riser and return system can be displaced to seawater after the disconnect by the subsea pump system without any spillage to the sea.

Figure 12:
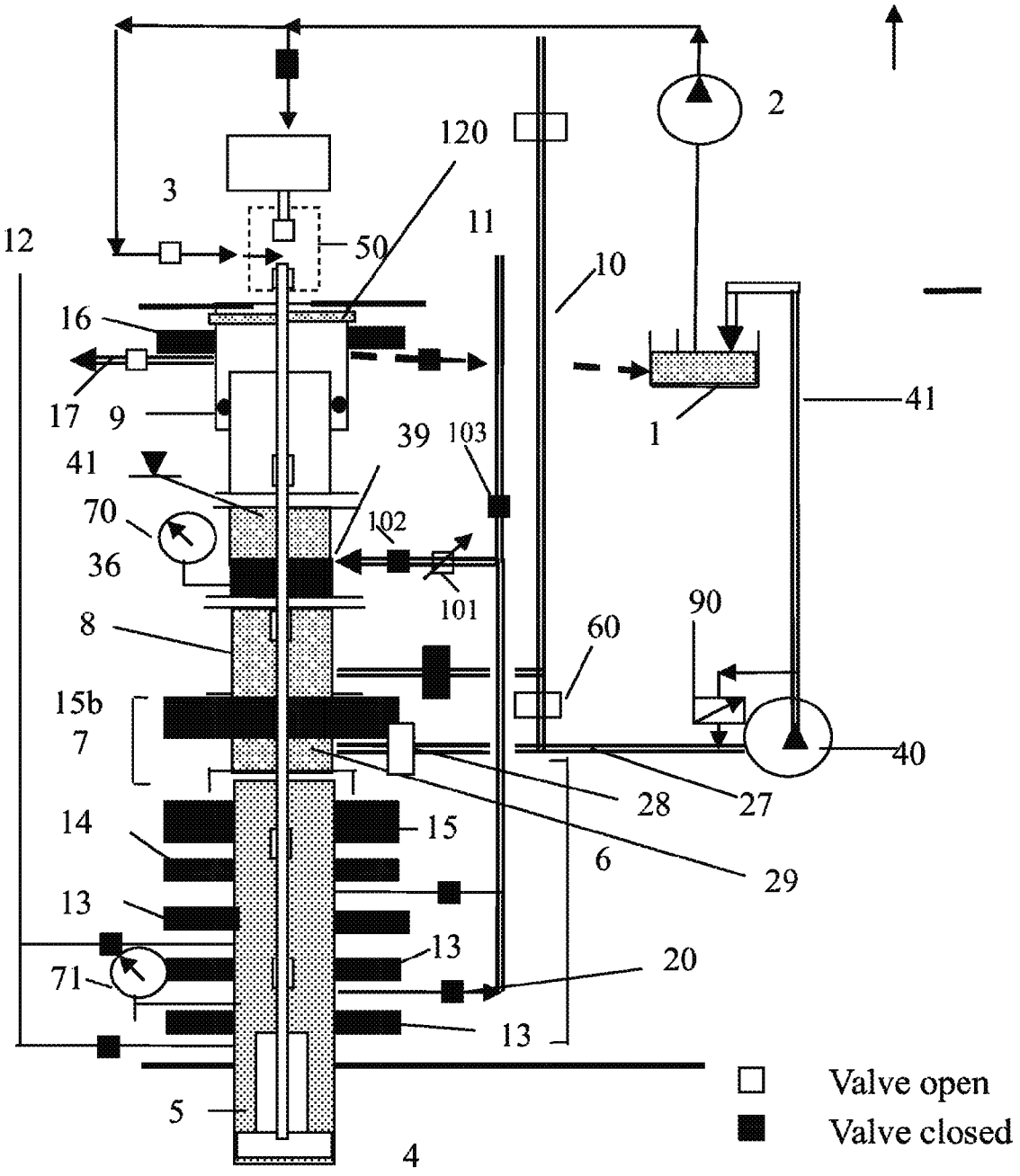
FIG. 12 shows an alternative setup when drilling from a MODU with 2 annular BOPs (15 and 15*b*) in relatively shallow waters (200-600 m) when the outlet to the subsea pump is close to the lower end of the marine riser.

FIG. 12 shows an alternative embodiment of the invention. This shows an alternative setup when drilling from a MODU with 2 annular BOPs (15 and 15*b*) in relatively shallow waters (200-600 m) when the outlet to the subsea pump is close to the lower end of the marine riser. The upper annular BOP (15*b*) is normally placed in the lower end of the marine drilling riser and normally above the marine riser disconnect point (RDP). Here an outlet to the subsea pump can be put below this element (15*b*) and a tie-in line between the pump suction line and the booster line (10), with appropriate valves and piping is arranged. In this fashion the upper annular preventer 15*b* can be closed when making connections and the mud level (42) in the booster line (10) used to compensate for the loss of friction pressure in the well when pumping down drill pipe is interrupted or changed. The reason for this procedure is that it will be much faster to compensate for changes to the annular well pressure due to the much smaller diameter of the booster line (10) compared to the main bore of the marine drilling riser (8). By introducing an additional bypass across the subsea pump 40 with a remote subsea choke valve (90), pumping across this pressure regulation device (90) the pressure regulation in the wellbore annulus will be even faster and make it possible to compensate for surge and swab effect due to rig heave on connections.

Other and various embodiments of the invention include a system for drilling subsea wells from a Mobile Offshore Drilling Unit (MODU), comprising a marine drilling riser arranged from the MODU to a seabed located Blow Out Preventer (BOP), a drill string arranged from the MODU through the marine drilling riser and BOP and further down a wellbore, at least one closing device arranged in the marine drilling riser, or in a high pressure part of the system below the marine drilling riser, such as integral with the BOP, the closing device being adapted to close the annulus outside the drill string, characterized in that the system further comprises at least one mud return outlet and mud conduit fluidly connected to the annulus at a lower part of the marine drilling riser or below, at a level below a low mud level (an interface gas/mud or liquid/mud typically lower than sea level) in the marine drilling riser, the at least one mud return outlet being connected to the annulus above the closing device, and being adapted for flowing drilling mud to a subsea lift pump, the pump being adapted to pump the received mud from the wellbore annulus to above sea level, and a means for separating gas from mud, coupled into the path of flow from the annulus to the subsea lift pump, and a means for dynamic regulation of annular well pressure, coupled to the path of flow from the annulus to the subsea lift pump.

The means for separating gas from mud and the means for dynamic regulation of annular well pressure may comprise the same structural parts. The system may comprise a well flow outlet from the well below the closing device, which is connected to a well flow inlet into the marine drilling riser above the at least one mud return outlet from the marine riser. The system may be configured so that during normal operation, mud is directed from the mud outlet to the subsea lift pump, while during unstable mode of operation, such as when encountering a gas kick, the closing device is closed and drilling fluid is directed from the annulus below the closed device to the subsea lift pump, via the means for separating gas and optionally via the means for dynamic regulation of annular well pressures.

Another embodiment of the invention is a system for drilling subsea wells from a Mobile Offshore Drilling Unit (MODU), comprising a marine drilling riser arranged from the MODU to a seabed located Blow Out Preventer (BOP), a drill string arranged from the MODU through the marine drilling riser and BOP and further down a wellbore, at least one closing devise arranged in the marine drilling riser, or in a high pressure part of the system below the marine drilling riser, such as integral with the BOP, the closing device can close the annulus outside the drill string, characterized in that the system further comprises at least one mud return outlet and mud conduit fluidly connected to the annulus at a lower part of the marine drilling riser or below, at a level below a low mud level (an interface gas/mud or liquid/mud typical lower than sea level) in the marine drilling riser, of which outlets and conduits at least one is fluidly connected to the annulus below said closing device, for flowing mud to a subsea lift pump that via piping or conduits can pump the received mud to above sea level, and a means for maintenance of a constant well bore annulus pressure, having fluid connection to the subsea lift pump, including valves and piping for fluidly connecting said means to the path of flow from the annulus to the subsea lift pump, the means including a pipe extending upwards from seabed or near seabed level through the sea, to a level above sea level and located upstream the subsea pump, providing a distance between the levels for adjustment of a liquid mud/gas interface or mud liquid level in the pipe in order to adjust and regulate the annular well pressure.

In either of these embodiments, the means for dynamically adjusting the well pressure may include a pipe extending upwards from a separator through the sea, a mud/gas interface level in the pipe being adjustable in order to adjust the bottom hole pressure.

The means for dynamically adjusting the well pressure may include the annulus outside the drill string above the closing device, including the annulus of the marine drilling riser, and the fluid conduit from the annulus below the closing device, towards the means and pump, may be via a choke line.

In either of these embodiments, a subsea choke valve may be provided in a choke line fluidly connecting the annulus below the closed device with the means for dynamically adjusting the well pressure, such that a choked flow of mud can be directed to the subsea lift pump via the means for separating gas from mud if the mud contains significant quantities of gas or if the bottom hole pressure is unstable, and the pipes and valves may be provided in order to by-pass the means for separating gas from mud and connect the choke line to the subsea lift pump.

In either of these embodiments, the means for dynamically adjusting the well pressure may include a pipe extending upwards from seabed or near seabed level through the sea, to a level above sea level, providing a distance between the levels for adjustment of a liquid mud/gas interface or mud/liquid level in the pipe in order to adjust and regulate the annular well pressure, and the pipe may include one of: a part of a booster line, a part of a choke line, a part of a kill line and the annulus of a drill string and the marine drilling riser, operatively connected to function as the pipe whenever the means is in operation.

Yet another embodiment of the invention is a subsea drilling system where drilling fluid is pumped down into the borehole through a drill string and returned back through the annulus between the drill string and the well bore, out of the drilling riser at a level between the seabed and the sea water, characterized in that a subsea located Blow Out Preventer (BOP) can be closed to seal off the annulus bore between the drill string and the bore hole, and drilling fluids are diverted from below the closed element in the subsea BOP in a separate line to above the BOP via at least one pressure reduction device (subsea choke valve) into the riser at a higher level than the pump outlet to a subsea mud pump that is connected to a conduit fluidly connected the mud process plant on the MODU above sea level.

The fluids from below the closed BOP may be diverted directly from the choke valve to the subsea lift pump via the valve bypassing the marine drilling riser. A separate liquid type with a lower liquid density compared to the drilling fluid in use may be located in the marine riser above the lower than sea level drilling fluid. A section in the marine drilling riser, above the fluid outlet for the pump and below the mud inlet may have a larger diameter compared to the riser below or above in order to reduce the downward fluid velocity and thus improve the gas—mud separation process. A continuous circulation system may be used.

An additional fluid may be supplied upstream of the choke valve to improve the performance of the pressure control system. An additional fluid may be supplied below/(upstream) of the subsea lift pump to improve the performance and avoid settling of drill cutting in the drilling riser above the BOP.

In still yet another embodiment of the invention, a subsea drilling system for controlling drilling fluid/well annular pressure, comprising a drill string, a marine drilling riser, a system for circulating drilling fluid by pumping it down into the borehole through a drill string and returning it back through the annulus between the drill string and the well bore, and a system for controlling annular well pressure by draining drilling fluid out of the drilling riser or BOP at a level between the seabed and the sea water level in order to adjust the hydrostatic head of drilling fluid, is characterized in that it further comprises a separator communication with the marine drilling riser and a gas vent line to the surface located upstream a liquid line to the surface.

A pump may be coupled to the liquid line downstream the connection to the gas vent line in order to pump the liquid to the surface. The vent line may be a separate conduit line or the choke line, or kill line, or riser booster line. The fluid return line from the bore hole to the gas separator, subsea lift pump and pump discharge line to surface may be connected to the riser at the riser section above the BOP. The fluid return from the bore hole to the gas separator, subsea lift pump and pump discharge line to surface may be connected via the choke line from the well bore below the BOP closing device. The separator may be an integrated part of the riser, or it may be located outside the riser.

An additional embodiment of the invention is a subsea drilling method where drilling fluid is pumped down into the borehole through a drill string and returned back through the annulus between the drill string and the well bore, and where the annulus wellbore pressure caused by the drilling fluid is controlled and regulated by draining drilling fluid out of the drilling riser at a level between the seabed and the sea water, thereby creating a lower mud/gas or mud/liquid interface level in the marine drilling riser, to a subsea mud lift pump that is fluidly connected to the mud process plant above the surface of water, in order to adjust the hydrostatic head and wellbore annulus pressures by regulating the mud/gas or mud/liquid interface level up or down, characterized in that a subsea located Blow Out Preventer (BOP) can be closed to seal off the annulus bore between the drill string and the bore hole, and any fluids are diverted from below the BOP in a separate line to above the BOP into the marine drilling riser at a higher level compared to the pump outlet level.

The line connecting the wellbore annulus below the closed BOP and the inlet to the marine drilling riser may contain at least one pressure reduction device (subsea choke valve) that can regulate the amount of flow into the marine drilling riser. The fluids from below the BOP may be diverted from the choke valve directly via a valve and piping to the subsea lift pump. The fluid velocity in the riser between the choke line inlet and the pump out let may be diverted downwards in the riser with a velocity lower than the rising velocity of the less dense gas in order to achieve gravity type separation and a net upwards rising velocity of the gas bubbles. The separated gas in the return fluid may be vented via the marine drilling riser and diverter system to the atmosphere.

A separate fluid type with a lower fluid density compared to the drilling fluid in use, may be located in the marine drilling riser above the drilling fluid level. A section in the marine riser, above the fluid outlet for the pump and below the fluid inlet from the well may have a larger diameter compared to the marine drilling riser above and below in order to reduce the downward fluid velocity and thus improve the separation process. A continuous circulation system may be used in combination with the circulation/drilling method.

Additional fluids may be supplied into the wellbore other than through the drill string upstream of the choke valve to improve the performance of the pressure control system. Additional fluids may be supplied upstream (e.g. through a booster line) of the subsea lift pump to improve the performance and avoid settling of formation particles in the suction line, discharge line and subsea lift pump. Additional fluids may be supplied below/upstream the subsea lift pump to improve the performance and avoid settling of drill cutting in the drilling riser above the BOP.

Gas escaping from a submarine formation into a borehole may be transported/circulated out of the borehole to the surface in the annulus between the drill string and the borehole and separated from the drilling fluid within the drilling riser which is kept open to the atmosphere above the sea level under ambient atmospheric pressure, and the combined hydrostatic and dynamic pressure at any one particular depth in the wellbore may be kept constant during the drilling process by regulation of the height of the liquid mud level in the main drilling riser.

Yet an additional embodiment of the invention is a subsea drilling method for controlling the wellbore annular pressure, where drilling fluid is pumped down into the borehole through a drill string and returned back through the annulus between the drill string and the well bore, and where wellbore annular pressure is controlled by draining drilling fluid out of the drilling riser or BOP at a level between the seabed and the sea water in order to adjust the hydrostatic head of drilling fluid, characterized in that the drained drilling fluid and gas is separated in a subsea separator where the gas is vented to surface through a vent line, and the fluid is pumped to surface via a pump.

An annular seal, located above an outlet from the riser to the separator, may be used to seal the annulus before the flow through the drill string is stopped and preferably after the drill string rotation is stopped, characterized in that the level of liquid in the vent line may be increased to compensate for the loss in annulus pressure when the flow of mud/fluid through the drill pipe is reduced or stopped. The liquid level in the vent line may be reduced when the flow circulation is commenced or increased in order to maintain a substantially constant bottom hole pressure.

An annular seal, located above an outlet from the riser to the separator, may be used to seal the annulus of the wellbore in the event that well fluids enter the bore hole, preferably after the drill string rotation has stopped. The lower density influx volume into the larger diameter bore hole may cause the higher density mud and gas interface in the small diameter vent line to increase, and the increase in height of mud/gas in the vent line or the corresponding pressure effect to the wellbore annulus due to the higher level being larger than the vertical height of influx of formation fluid in the borehole annulus or the corresponding lower bottom hole pressure due to the lower density influx height, to achieve a self-adjusted pressure balance method in the bore hole annulus with formation pressure. An annular seal, located above an outlet from the riser to a separator, may be used to seal the annulus before the flow through the drill string is stopped and preferable after the drill string rotation is stopped where the pump and a hydrostatic head in the pump discharge line are used to compensate for surge and swab pressure.

And yet still another embodiment of the invention is a subsea drilling method for controlling the annular wellbore pressure, where drilling fluid is pumped down into the borehole through a drill string and returned back through the annulus between the drill string and the well bore, and where the wellbore annulus pressure caused by the drilling fluid is controlled by draining drilling fluid out of the drilling riser or BOP at a level between the seabed and the sea water in order to adjust the hydrostatic head of drilling fluid, characterized in that the drained drilling fluid and gas is separated in a subsea separator where the gas is vented to surface through a vent line, and the fluid is pumped to surface via a subsea mud pump. A liquid mud/gas interface level in the vent line may be regulated up or down with the subsea mud lift pump in order to regulate the wellbore pressure accordingly.

Another additional embodiment of the invention is a subsea drilling method for maintaining constant bottom hole pressure in a well during drilling and well circulation, after an influx of formation fluid containing gas into the wellbore annulus has occurred, where drilling fluid is pumped down into the borehole through a drill string and returned back through the annulus between the drill string and the well bore, characterized in that the wellbore bottom hole pressure is maintained or regulated by draining more or less drilling fluid out of the wellbore annulus than what is being pumped into the wellbore annulus, from a level between the seabed and the sea water surface, in order to adjust the hydrostatic head of drilling fluid (mud)/gas interface level up or down, the gas phase being open to atmospheric pressure, that the influxes (influxed volume) is pumped from the influx depth up the annulus of the wellbore to a height preferably close to the annulus outlet, stopping completely or reducing the pumping process down the drill string and/or into the wellbore annulus to a minimum, while regulating the wellbore annulus pressure to equal or above that of the open hole formation pressure by regulating the mud/gas interface level, letting the influx raise to surface by gravity separation under constant bottom hole pressure without any other physical interference or regulation needed.

All the features mentioned above and in the dependent claims, in addition to the obligatory features of the independent claims but excluding prior art features in conflict with the invention, can be included into the systems and methods of the present invention, in any combination, and such combinations are a part of the present invention.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

This specification is not intended to be exhaustive. Although the present application is shown in a limited number of forms, the scope of the invention is not limited to just these forms, but is amenable to various changes and modifications without departing from the spirit thereof. One or ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

I claim:

1. A subsea drilling method, comprising:

pumping drilling fluid down into a borehole through a drill string, returning the drilling fluid back through an annulus, said annulus being formed between the drill string and the well bore, and between the drill string and a drilling riser surrounding the drill string above the seabed;

draining drilling fluid out of the drilling riser at a level between the seabed and the sea surface through an outlet to a subsea mud lift pump that is fluidly connected to a mud processing plant above the sea surface, thereby creating a drilling fluid interface below the sea surface between the drilling fluid in the annulus within the drilling riser and either gas or liquid extending in the annulus above the drilling fluid, a height of the drilling fluid interface thereby controlling and regulating a pressure of the drilling fluid in the annulus within the wellbore; and providing a wiper or rotary closing element to seal off the annulus between the drill string and the riser above the outlet; and venting gas from the riser to a gas destination at atmospheric pressure.

2. The subsea drilling method according to claim 1, wherein a seabed BOP is kept open to allow fluid communication between the well and the riser.

3. The subsea drilling method according to claim 1, wherein said wiper or rotary closing element is arranged above said interface.

4. The subsea drilling method according to claim 1, wherein said interface, and hence said pressure of said drilling fluid in the annulus, is controlled by regulating the pump rate of said lift pump.

5. The subsea drilling method according to claim 1, wherein a seabed BOP is closed and fluid communication between the well and the riser is provided through a bypass line.

6. The subsea drilling method according to claim 1, wherein a continuous circulation system is used in combination with a circulation and drilling method.

7. The subsea drilling method according to claim 1, wherein additional fluid other than the drilling fluid supplied through the drill string is supplied into the wellbore upstream of a choke valve, thereby improving the regulation of the pressure of the drilling fluid in the annulus within the wellbore.

8. The subsea drilling method according to claim 1, wherein additional fluid is supplied through a booster line upstream of the subsea lift pump to avoid settling of formation particles from the drilling fluid.

9. The subsea drilling method according to claim 1, wherein a combined hydrostatic and dynamic pressure at a specified depth in the wellbore is kept constant during a drilling process by regulation of the height of the drilling fluid interface in the annulus within the drilling riser.

10. A subsea drilling method according to claim 1, further comprising using an inert gas to purge the drilling riser.

* * * * *